US012635723B2

(12) United States Patent
Johnson et al.

(10) Patent No.: US 12,635,723 B2
(45) Date of Patent: May 26, 2026

(54) POUCHED PRODUCTS WITH HEAT SEALABLE BINDER

(71) Applicant: NICOVENTURES TRADING LIMITED, London (GB)

(72) Inventors: Savannah Johnson, Winston-Salem, NC (US); Dwayne William Beeson, Kernersville, NC (US); Ronald K. Hutchens, East Bend, NC (US); Wesley Steven Jones, Lexington, NC (US); David Neil McClanahan, Winston-Salem, NC (US); Travis O'Neal, Pinnacle, NC (US); Pankaj Patel, Clemmons, NC (US)

(73) Assignee: Nicoventures Trading Limited, London (GB)

( * ) Notice: Subject to any disclaimer, the term of this patent is extended or adjusted under 35 U.S.C. 154(b) by 910 days.

(21) Appl. No.: 17/205,795

(22) Filed: Mar. 18, 2021

(65) Prior Publication Data

US 2021/0204585 A1 Jul. 8, 2021

Related U.S. Application Data

(63) Continuation of application No. PCT/IB2020/061617, filed on Dec. 8, 2020.

(Continued)

(51) Int. Cl.

*A24B 13/00* (2006.01)
*A24B 15/16* (2020.01)

(Continued)

(52) U.S. Cl.

CPC ..... *A24B 13/00* (2013.01); *A24B 15/16* (2013.01); *A24F 23/02* (2013.01); *D04H 1/54* (2013.01);

(Continued)

(58) Field of Classification Search

None

See application file for complete search history.

(56) References Cited

U.S. PATENT DOCUMENTS 2,475,241 A 7/1949 Hermanson
3,106,485 A * 10/1963 Guillet ..... D21H 25/06 427/398.2

(Continued)

FOREIGN PATENT DOCUMENTS

EP 1039024 9/2000
EP 2428126 3/2012

(Continued)

OTHER PUBLICATIONS

Kiekins et al., "Non-Wovens From Cotton Fibres for Absorbent Products Obtained by the Needle-Punching Process," Autex Research Journal, Dec. 2002, 2(4), 9 pp.

(Continued)

*Primary Examiner* — Katherine A Will

(74) *Attorney, Agent, or Firm* — Womble Bond Dickinson (US) LLP

(57) ABSTRACT

A pouched product adapted for release of a water-soluble component therefrom is provided herein. The pouched product can include an outer water-permeable pouch defining a cavity containing a composition that includes a water-soluble component capable of being released through the water-permeable pouch and has a surface area, wherein the outer water-permeable pouch can include a nonwoven web including a heat sealable binder coating having a melting point of about 300° C. or less. Heat sealable binders having a melting point of about 450° C. or greater are also provided herein.

17 Claims, 3 Drawing Sheets

Related U.S. Application Data

(60) Provisional application No. 62/945,687, filed on Dec. 9, 2019.

(51) Int. Cl.

| | |
|---|---|
| ***A24F 23/02*** | (2006.01) |
| ***D04H 1/54*** | (2012.01) |
| ***D04H 1/58*** | (2012.01) |
| ***D04H 3/12*** | (2006.01) |
| ***D04H 3/14*** | (2012.01) |

(52) U.S. Cl.
CPC ..... *D04H 1/58* (2013.01); *D04H 3/12* (2013.01); *D04H 3/14* (2013.01)

(56) References Cited

U.S. PATENT DOCUMENTS

| | | | |
|---|---|---|---|
| 3,338,992 | A | 8/1967 | Kinney |
| 3,341,394 | A | 9/1967 | Kinney |
| 3,502,763 | A | 3/1970 | Hartmann |
| 3,542,615 | A | 11/1970 | Dobo et al. |
| 3,692,618 | A | 9/1972 | Dorschner et al. |
| 3,734,812 | A | 5/1973 | Yazawa |
| 3,802,817 | A | 4/1974 | Matsuki et al. |
| 3,849,241 | A | 11/1974 | Buntin et al. |
| 3,972,759 | A | 8/1976 | Buntin |
| 4,340,563 | A | 7/1982 | Appel et al. |
| 4,622,259 | A | 11/1986 | McAmish et al. |
| 4,907,605 | A | 3/1990 | Ray et al. |
| 5,167,244 | A | 12/1992 | Kjerstad |
| 5,200,246 | A | 4/1993 | Sabee |
| 5,334,446 | A | 8/1994 | Quantrille et al. |
| 7,032,601 | B2 | 4/2006 | Atchley et al. |
| 7,498,281 | B2 | 3/2009 | Iwasaki et al. |
| 7,861,728 | B2 | 1/2011 | Holton, Jr. et al. |
| 7,950,399 | B2 | 5/2011 | Winterson et al. |
| 7,980,251 | B2 | 7/2011 | Winterson et al. |
| 8,067,046 | B2 | 11/2011 | Schleef et al. |
| 8,124,147 | B2 | 2/2012 | Cheng et al. |
| 8,336,557 | B2 | 12/2012 | Kumar et al. |
| 8,557,071 | B2 | 10/2013 | Weiler |
| 8,627,828 | B2 | 1/2014 | Strickland et al. |
| 8,747,562 | B2 | 6/2014 | Mishra et al. |
| 8,833,378 | B2 | 9/2014 | Axelsson et al. |
| 8,846,075 | B2 | 9/2014 | Jonsson et al. |
| 8,863,755 | B2 | 10/2014 | Zhuang et al. |
| 8,931,493 | B2 | 1/2015 | Sebastian et al. |
| 8,978,661 | B2 | 3/2015 | Atchley et al. |
| 8,992,974 | B2 | 3/2015 | McCarty |
| 9,066,540 | B2 | 6/2015 | Atchley et al. |
| 9,125,434 | B2 | 9/2015 | Fuisz |
| 9,161,567 | B2 | 10/2015 | Shikata et al. |
| 9,161,908 | B2 | 10/2015 | Nilsson |
| 9,167,835 | B2 | 10/2015 | Sengupta et al. |
| 9,185,931 | B2 | 11/2015 | Gao et al. |
| 9,358,296 | B2 | 6/2016 | McCarty |
| 9,402,414 | B2 | 8/2016 | Griscik et al. |
| 9,402,809 | B2 | 8/2016 | Axelsson et al. |
| 9,414,624 | B2 | 8/2016 | Carroll et al. |
| 9,462,827 | B2 | 10/2016 | Carroll et al. |
| 9,468,233 | B2 | 10/2016 | Macko et al. |
| 9,521,864 | B2 | 12/2016 | Gao et al. |
| 9,693,582 | B2 | 7/2017 | Carroll et al. |
| 9,848,634 | B2 | 12/2017 | Fuisz |
| 9,854,830 | B2 | 1/2018 | Gao et al. |
| 9,854,831 | B2 | 1/2018 | Gao et al. |
| 9,884,015 | B2 | 2/2018 | Gao et al. |
| 9,925,145 | B2 | 3/2018 | Hübinette et al. |
| 9,930,909 | B2 | 4/2018 | Gao et al. |
| 9,986,756 | B2 | 6/2018 | Gao et al. |
| 9,999,243 | B2 | 6/2018 | Gao et al. |
| 10,105,320 | B2 | 10/2018 | Gao et al. |
| 10,130,120 | B2 | 11/2018 | Mishra et al. |
| 10,244,786 | B2 | 4/2019 | Gao et al. |
| 10,258,076 | B2 | 4/2019 | Carroll et al. |
| 10,315,889 | B2 | 6/2019 | Kreischer et al. |
| 10,327,467 | B2 | 6/2019 | Carroll et al. |
| 10,334,873 | B2 | 7/2019 | Mishra et al. |
| 10,463,070 | B2 | 11/2019 | Carroll et al. |
| 10,609,949 | B2 | 4/2020 | Hodin et al. |
| 10,639,275 | B2 | 5/2020 | Gao et al. |
| 10,647,459 | B2 | 5/2020 | Persson |
| 2004/0094474 | A1 | 5/2004 | Heinrich et al. |
| 2004/0118421 | A1 | 6/2004 | Hodin et al. |
| 2004/0121689 | A1 | 6/2004 | Anderson et al. |
| 2004/0166756 | A1 | 8/2004 | Kurihara et al. |
| 2005/0061339 | A1 | 3/2005 | Hansson et al. |
| 2007/0012328 | A1 | 1/2007 | Winterson et al. |
| 2007/0062549 | A1 | 3/2007 | Holton et al. |
| 2007/0122526 | A1 | 5/2007 | Sweeney et al. |
| 2007/0186941 | A1 | 8/2007 | Holton, Jr. et al. |
| 2007/0190157 | A1 | 8/2007 | Sanghvi et al. |
| 2008/0029110 | A1 | 2/2008 | Dube et al. |
| 2008/0085649 | A1 | 4/2008 | Salamero et al. |
| 2008/0202532 | A1 | 8/2008 | Wygal |
| 2008/0202536 | A1 | 8/2008 | Torrence et al. |
| 2008/0249492 | A1 | 10/2008 | Schmidt |
| 2008/0302682 | A1 | 12/2008 | Engstrom et al. |
| 2008/0317911 | A1 | 12/2008 | Schleef et al. |
| 2009/0022917 | A1 | 1/2009 | Gedevanishvili et al. |
| 2009/0133704 | A1 | 5/2009 | Strickland et al. |
| 2010/0018539 | A1 | 1/2010 | Brinkley et al. |
| 2010/0018541 | A1 | 1/2010 | Gerardi et al. |
| 2010/0330236 | A1 | 12/2010 | Miyahara et al. |
| 2011/0180087 | A1 | 7/2011 | Gee et al. |
| 2011/0268809 | A1 | 11/2011 | Brinkley et al. |
| 2011/0303232 | A1 | 12/2011 | Williams |
| 2011/0303511 | A1 | 12/2011 | Brinkley et al. |
| 2012/0031416 | A1 | 2/2012 | Atchley et al. |
| 2012/0051672 | A1 | 3/2012 | Foss et al. |
| 2012/0055493 | A1 | 3/2012 | Novak, III et al. |
| 2012/0103353 | A1 | 5/2012 | Sebastian |
| 2012/0237640 | A1 | 9/2012 | Buffet et al. |
| 2013/0206150 | A1 | 8/2013 | Duggins et al. |
| 2013/0251779 | A1 | 9/2013 | Svandal et al. |
| 2013/0276801 | A1 | 10/2013 | Byrd et al. |
| 2014/0017286 | A1 | 1/2014 | Nilsson |
| 2014/0026912 | A1 | 1/2014 | Rushforth et al. |
| 2014/0083438 | A1 | 3/2014 | Sebastian et al. |
| 2014/0141677 | A1 | 5/2014 | Tai et al. |
| 2014/0157728 | A1 | 6/2014 | Williams |
| 2014/0255452 | A1 | 9/2014 | Reddick et al. |
| 2014/0261473 | A1 | 9/2014 | Carroll et al. |
| 2014/0271791 | A1 | 9/2014 | Mishra et al. |
| 2015/0068545 | A1 | 3/2015 | Moldoveanu et al. |
| 2015/0096573 | A1 | 4/2015 | Gao et al. |
| 2015/0096574 | A1 | 4/2015 | Gao et al. |
| 2015/0096576 | A1 | 4/2015 | Gao et al. |
| 2015/0175329 | A1 | 6/2015 | Wilke et al. |
| 2015/0189910 | A1 | 7/2015 | Sebastian et al. |
| 2016/0000140 | A1 | 1/2016 | Sebastian et al. |
| 2016/0073689 | A1 | 3/2016 | Sebastian et al. |
| 2016/0157515 | A1 | 6/2016 | Chapman et al. |
| 2016/0165953 | A1 | 6/2016 | Goode, Jr. |
| 2016/0192703 | A1 | 7/2016 | Sebastian et al. |
| 2016/0208440 | A1 | 7/2016 | Byrd et al. |
| 2016/0324777 | A1 | 11/2016 | Victor et al. |
| 2017/0188622 | A1 | 7/2017 | Wilson |
| 2017/0280764 | A1 | 10/2017 | Sahlén et al. |
| 2017/0318858 | A1 | 11/2017 | Hodin et al. |
| 2018/0051002 | A1 | 2/2018 | Dull et al. |
| 2018/0140007 | A1 | 5/2018 | Aspgren et al. |
| 2018/0153211 | A1 | 6/2018 | Persson |
| 2018/0255801 | A1 | 9/2018 | Victor |
| 2018/0255826 | A1 | 9/2018 | Persson et al. |
| 2019/0255035 | A1 | 8/2019 | Bruun |
| 2019/0291900 | A1 | 9/2019 | Persson et al. |
| 2020/0037638 | A1 | 2/2020 | Faraci et al. |
| 2020/0128870 | A1 | 4/2020 | Hassler et al. |
| 2020/0275689 | A1 | 9/2020 | Lewerenz |
| 2020/0297024 | A1 | 9/2020 | Bodin |
| 2020/0297026 | A1 | 9/2020 | Kannisto et al. |
| 2020/0383372 | A1 | 12/2020 | Stahl et al. |

(56) References Cited

U.S. PATENT DOCUMENTS

| | | | |
|---|---|---|---|
| 2020/0383373 | A1 | 12/2020 | Stahl et al. |
| 2021/0068446 | A1 | 3/2021 | Keller et al. |
| 2021/0169790 | A1 | 6/2021 | Johnson et al. |
| 2021/0186095 | A1 | 6/2021 | Sebastian et al. |
| 2021/0204585 | A1 | 7/2021 | Johnson et al. |
| 2021/0204590 | A1 | 7/2021 | Johnson et al. |
| 2022/0225660 | A1 | 7/2022 | Joyce et al. |

FOREIGN PATENT DOCUMENTS

| | | | | |
|---|---|---|---|---|
| EP | 3192380 | | 7/2017 | |
| GB | 1273040 | | 5/1972 | |
| GB | 2319265 | | 5/1998 | |
| WO | WO 2007/037962 | | 4/2007 | |
| WO | WO 2010/014506 | | 2/2010 | |
| WO | WO-2012061192 | A1 * | 5/2012 | ..... A24B 13/00 |
| WO | WO 2016/083463 | | 6/2016 | |
| WO | WO 2019/036243 | | 2/2019 | |
| WO | WO 2020/169514 | | 8/2020 | |
| WO | WO 2020/187812 | | 9/2020 | |
| WO | WO 2022/112085 | | 6/2022 | |

OTHER PUBLICATIONS

Liu "Flavoring-Changing Chewing Gum" Science and Food UCLA, Jul. 7, 2015, pp. 1-5. https://scienceandfooducla.wordpress.com/2015/0/07/flavor-changing-chewing-gum/.

Patel et al., "Needle Punching Technology," Department of Textile Engineering, The Maharaha Sayajirao University of Baroda, Vadodara, Feb. 2010, 9 pp.

Pinnau et al., "Formation and Modification of Polymeric Membranes: Overview," Membrane Formation and Modification, ACS Symposium Series, American Chemical Society: Washington, DC, 1999, 22 pp.

* cited by examiner

POUCHED PRODUCTS WITH HEAT SEALABLE BINDER

CROSS-REFERENCE TO RELATED APPLICATIONS

This application is a continuation of International Application No. PCT/IB2020/061617, filed Dec. 8, 2020, which claims priority from U.S. Provisional Application No. 62/945,687, filed Dec. 9, 2019, which applications are hereby incorporated in their entirety by reference in this application.

FIELD OF THE DISCLOSURE

The present disclosure relates to flavored products intended for human use. The products are configured for oral use and deliver substances such as flavors and/or active ingredients during use. Such products may include tobacco or a product derived from tobacco, or may be tobacco-free alternatives.

BACKGROUND

Tobacco may be enjoyed in a so-called "smokeless" form. Particularly popular smokeless tobacco products are employed by inserting some form of processed tobacco or tobacco-containing formulation into the mouth of the user. Conventional formats for such smokeless tobacco products include moist snuff, snus, and chewing tobacco, which are typically formed almost entirely of particulate, granular, or shredded tobacco, and which are either portioned by the user or presented to the user in individual portions, such as in single-use pouches or sachets. Other traditional forms of smokeless products include compressed or agglomerated forms, such as plugs, tablets, or pellets. Alternative product formats, such as tobacco-containing gums and mixtures of tobacco with other plant materials, are also known. See for example, the types of smokeless tobacco formulations, ingredients, and processing methodologies set forth in U.S. Pat. No. 1,376,586 to Schwartz; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; U.S. Pat. No. 5,387,416 to White et al.; U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; and U.S. Pat. No. 7,694,686 to Atchley et al.; US Pat. Pub. Nos. 2004/0020503 to Williams; 2005/0115580 to Quinter et al.; 2006/0191548 to Strickland et al.; 2007/0062549 to Holton, Jr. et al.; 2007/0186941 to Holton, Jr. et al.; 2007/0186942 to Strickland et al.; 2008/0029110 to Dube et al.; 2008/0029116 to Robinson et al.; 2008/0173317 to Robinson et al.; 2008/0209586 to Neilsen et al.; 2009/0065013 to Essen et al.; and 2010/0282267 to Atchley, as well as WO2004/095959 to Arnarp et al., each of which is incorporated herein by reference.

Smokeless tobacco product configurations that combine tobacco material with various binders and fillers have been proposed more recently, with example product formats including lozenges, pastilles, gels, extruded forms, and the like. See, for example, the types of products described in US Patent App. Pub. Nos. 2008/0196730 to Engstrom et al.; 2008/0305216 to Crawford et al.; 2009/0293889 to Kumar et al.; 2010/0291245 to Gao et al; 2011/0139164 to Mua et al.; 2012/0037175 to Cantrell et al.; 2012/0055494 to Hunt et al.; 2012/0138073 to Cantrell et al.; 2012/0138074 to Cantrell et al.; 2013/0074855 to Holton, Jr.; 2013/0074856 to Holton, Jr.; 2013/0152953 to Mua et al.; 2013/0274296 to Jackson et al.; 2015/0068545 to Moldoveanu et al.; 2015/0101627 to Marshall et al.; and 2015/0230515 to Lampe et al., each of which is incorporated herein by reference.

Certain types of pouches or sachets have been employed to contain compositions adapted for oral use. See for example, the types of representative smokeless tobacco products, as well as the various smokeless tobacco formulations, ingredients and processing methodologies, referenced in the background art set forth in U.S. Pat. Pub. Nos. 2011/0303511 to Brinkley et al. and 2013/0206150 to Duggins et al.; which are incorporated herein by reference. During use, those pouches or sachets are inserted into the mouth of the user, and water soluble components contained within those pouches or sachets are released as a result of interaction with saliva.

Certain commercially available smokeless tobacco products, such as products commonly referred to as "snus," comprise ground tobacco materials incorporated within sealed pouches. Representative types of snus products have been manufactured in Europe, particularly in Sweden, by or through companies such as Swedish Match AB (e.g., for brands such as General, Ettan, Goteborgs Rape and Grovsnus); Fiedler & Lundgren AB (e.g., for brands such as Lucky Strike, Granit, Krekt and Mocca); JTI Sweden AB (e.g., for brands such as Gustavus) and Rocker Production AB (e.g., for brands such as Rocker). Other types of snus products have been commercially available in the U.S.A. through companies such as Philip Morris USA, Inc. (e.g., for brands such as Marlboro Snus); U.S. Smokeless Tobacco Company (e.g., for brands such as SKOAL Snus) and R. J. Reynolds Tobacco Company (e.g., for brands such as CAMEL Snus). See also, for example, Bryzgalov et al., 1N1800 Life Cycle Assessment, Comparative Life Cycle Assessment of General Loose and Portion Snus (2005); which is incorporated herein by reference.

Various types of snus products, as well as components for those products and methods for processing components associated with those products, have been proposed. See, for example, U.S. Pat. No. 8,067,046 to Schleef et al. and U.S. Pat. No. 7,861,728 to Holton, Jr. et al.; US Pat. Pub. Nos. 2004/0118422 to Lundin et al.; 2008/0202536 to Torrence et al.; 2009/0025738 to Mua et al.; 2011/0180087 to Gee et al.; 2010/0218779 to Zhuang et al.; 2010/0294291 to Robinson et al.; 2010/0300465 to Zimmermann; 2011/0061666 to Dube et al.; 2011/0303232 to Williams et al.; 2012/0067362 to Mola et al.; 2012/0085360 to Kawata et al.; 2012/0103353 to Sebastian et al. and 2012/0247492 to Kobal et al.; and PCT Pub. Nos. WO 05/063060 to Atchley et al. and WO 08/56135 to Onno; which are incorporated herein by reference. In addition, certain quality standards associated with snus manufacture have been assembled as a so-called GothiaTek standard. Furthermore, various manners and methods useful for the production of snus types of products have been proposed. See, for example, U.S. Pat. No. 4,607,479 to Linden and U.S. Pat. No. 4,631,899 to Nielsen; and US Pat. Pub. Nos. 2008/0156338 to Winterson et al.; 2010/0018539 to Brinkley et al.; 2010/0059069 to Boldrini; 2010/0071711 to Boldrini; 2010/0101189 to Boldrini; 2010/0101588 to Boldrini; 2010/0199601 to Boldrini; 2010/0200005 to Fallon; 2010/0252056 to Gruss et al.; 2011/0284016 to Gunter et al.; 2011/0239591 to Gruss et al.; 2011/0303511 to Brinkley et al.; 2012/0055493 to Novak III et al. and 2012/0103349 to Hansson et al.; and PCT Pub. Nos. WO 2008/081341 to Winterson et al. and WO 2008/

146160 to Cecil et al.; which are incorporated herein by reference. Additionally, snus products can be manufactured using equipment such as that available as SB 51-1/T, SBL 50 and SB 53-2/T from Merz Verpackungmaschinen GmbH.

Certain types of products employing pouches or sachets that contain tobacco substitutes (or combinations of tobacco and tobacco substitutes) also have been proposed. See, for example, U.S. Pat. No. 5,167,244 to Kjerstad and U.S. Pat. No. 7,950,399 to Winterson et al.; and US Pat. Pub. Nos. 2005/0061339 to Hansson et al.; 2011/0041860 to Essen et al. and 2011/0247640 to Beeson et al.; which are incorporated herein by reference.

Certain types of product employing pouches or sachets have been employed to contain nicotine, such as those used for nicotine replacement therapy (NRT) types of products (e.g., a pharmaceutical product distributed under the tradename ZONNIC® by Niconovum AB). See also, for example, the types of pouch materials and nicotine-containing formulations set forth in U.S. Pat. No. 4,907,605 to Ray et al.; US Pat. Pub. Nos. 2009/0293895 to Axelsson et al. and 2011/0268809 to Brinkley et al.; and PCT Pub. Nos. WO 2010/031552 to Axelsson et al. and WO 2012/134380 to Nilsson; which are incorporated herein by reference.

To manufacture pouched products of the type noted above, the pouches must be sealed after being filled with the desired material. As noted in US Pat. Pub. No. 2014/0026912 to Rushforth et al., such sealing is typically accomplished by application of a binder material to the fiber network, which enables the pouch to be sealed upon application of heat. However, conventional binders applied to such fibrous pouches, such as acrylic polymers, are costly to apply to pouches and inhibit biodegradability of the discarded pouch.

All-white snus portions are growing in popularity, and offer a discrete and aesthetically pleasing alternative to traditional snus. Such modern "white" pouched products may include a bleached tobacco or may be tobacco-free.

BRIEF SUMMARY

The present disclosure relates to a pouched product adapted for release of a water-soluble component therefrom, wherein the pouched product can include an outer water-permeable pouch defining a cavity containing a composition comprising a water-soluble component capable of being released through the water-permeable pouch. The outer water-permeable pouch material can comprise a low melting point heat sealable binder, wherein the heat sealable binder has a melting point of about 300° C. or less.

In certain embodiments, the composition within the cavity of the pouch can contain a tobacco-derived product, such as a particulate tobacco material, nicotine, particulate non-tobacco material (e.g., microcrystalline cellulose) that has been treated to contain nicotine and/or flavoring agents, or fibrous plant material (e.g., beet pulp fiber) treated to contain a tobacco extract. In various embodiments, the composition within the cavity of the pouch is a smokeless tobacco product or nicotine replacement therapy product. In some embodiments, the composition within the cavity of the pouch can be a particulate material adapted for steeping or brewing (i.e., configured for liquid extraction), such as a tea or coffee material. Accordingly, in certain embodiments, the composition within the cavity of the pouch can comprise a particulate or fibrous plant material such as would be found in various teas or tea variants. In some embodiments, the composition within the cavity can comprise a flavor component such that flavor can be added to a liquid (e.g., water).

The invention includes, without limitation, the following embodiments.

Embodiment 1: A pouched product adapted for release of a water-soluble component therefrom, comprising: a composition comprising a water-soluble component; an outer water-permeable pouch defining a cavity containing the composition; wherein the water-soluble component is capable of being released through the water-permeable pouch; wherein the outer water-permeable pouch comprises a nonwoven web comprising a heat sealable binder; and wherein the heat sealable binder has a melting point of about 300° C. or less.

Embodiment 2: The pouched product of Embodiment 1, wherein the heat sealable binder has a melting point of about 250° C. or less.

Embodiment 3: The pouched product of any of Embodiments 1-2, wherein the heat sealable binder has a melting point of about 150° C. or less.

Embodiment 4: The pouched product of any of Embodiments 1-3, wherein the heat sealable binder comprises a degradable polymer.

Embodiment 5: The pouched product of any of Embodiments 1-4, wherein the heat sealable binder is in the form of a liquid coating.

Embodiment 6: The pouched product of any of Embodiments 1-5, wherein the heat sealable binder is in the form of a powder.

Embodiment 7: The pouched product of any of Embodiments 1-6, wherein the composition within the cavity of the pouch comprises at least one of a particulate tobacco material, nicotine, particulate non-tobacco material treated to contain nicotine and/or flavoring agents, and fibrous plant material treated to contain a tobacco extract.

Embodiment 8: The pouched product according to any of Embodiments 1-6, wherein the composition is substantially free of a tobacco material.

Embodiment 9: The pouched product of any of Embodiments 1-8, wherein the composition comprises an active ingredient selected from the group consisting of a nicotine component, botanicals, stimulants, nutraceuticals, amino acids, vitamins, cannabinoids, cannabimimetics, terpenes, and combinations thereof.

Embodiment 10: The use of a nonwoven web comprising a heat sealable binder having a melting point of about 300° C. or less in an oral pouched product.

Embodiment 11: A method of preparing a water-permeable pouch material, comprising: providing a fibrous web comprising a plurality of fibers and a heat sealable binder material; mechanically entangling the fibrous web to form a nonwoven web; and heating the nonwoven web to at least partially melt the heat sealable binder material to form the water-permeable pouch material; wherein the heat sealable binder material has a melting point of 300° C. or less.

Embodiment 12: The method of Embodiment 11, further comprising: providing a continuous supply of the pouch material; engaging lateral edges of the pouch material such that a longitudinally-extending seam is formed; sealing the longitudinally-extending seam such that a continuous tubular member is formed from the continuous supply of pouch material; inserting a composition adapted for oral use into the continuous tubular member; subdividing the continuous tubular member into discrete pouch portions such that each pouch portion includes a composition charge; and sealing a leading and an end edge of each discrete pouch portion such that an outer water-permeable pouch is formed that encloses the composition charge.

Embodiment 13: A pouched product prepared according to the method of any of Embodiments 11-12.

Embodiment 14: A method of enhancing biodegradability of a pouched product, comprising: providing a fibrous web comprising a plurality of fibers and a low melting point heat sealable binder material, wherein the heat sealable binder material has a melting point of 300° C. or less; forming a water-permeable pouch from the fibrous web; and enclosing a composition comprising a water soluble component within the water-permeable pouch to form the pouched product; wherein the water-soluble component is capable of being released through the water-permeable pouch.

Embodiment 15: The method of any of Embodiments 11-12 and 14, wherein each of the plurality of fibers comprises a degradable polymer component.

Embodiment 16: A pouched product formed according to the method of any of Embodiments 14-15, wherein the pouched product exhibits enhanced degradability as compared with a conventional pouched product that is otherwise comparable but does not comprise the low melting point heat sealable binder material.

Embodiment 17: A pouched product adapted for release of a water-soluble component therefrom, comprising: a composition comprising a water-soluble component; an outer water-permeable pouch defining a cavity containing the composition; wherein the water-soluble component is capable of being released through the water-permeable pouch; wherein the outer water-permeable pouch comprises a nonwoven web comprising a heat sealable binder; and wherein the heat sealable binder has a melting point of about 300° C. or greater.

Embodiment 18: The pouched product of Embodiment 17, wherein the heat sealable binder comprises at least one wax.

Embodiment 19: The use of a nonwoven web comprising a heat sealable binder having a melting point of about 300° C. or greater in an oral pouched product.

Embodiment 20: A method of preparing a water-permeable pouch material, comprising: providing a fibrous web comprising a plurality of fibers and a heat sealable binder material; mechanically entangling the fibrous web to form a nonwoven web; and heating the nonwoven web to at least partially melt the heat sealable binder material to form the water-permeable pouch material; wherein the heat sealable binder material has a melting point of about 300° C. or greater.

Embodiment 21: The method of Embodiment 20, further comprising: providing a continuous supply of the pouch material; engaging lateral edges of the pouch material such that a longitudinally-extending seam is formed; sealing the longitudinally-extending seam such that a continuous tubular member is formed from the continuous supply of pouch material; inserting a composition adapted for oral use into the continuous tubular member; subdividing the continuous tubular member into discrete pouch portions such that each pouch portion includes a composition charge; and sealing a leading and an end edge of each discrete pouch portion such that an outer water-permeable pouch is formed that encloses the composition charge.

These and other features, aspects, and advantages of the disclosure will be apparent from a reading of the following detailed description together with the accompanying drawings, which are briefly described below. The invention includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed invention, in any of its various aspects and embodiments, should be viewed as intended to be combinable unless the context clearly dictates otherwise.

BRIEF DESCRIPTION OF THE DRAWINGS

Having thus described aspects of the disclosure in the foregoing general terms, reference will now be made to the accompanying drawings, which are not necessarily drawn to scale. The drawings are example only, and should not be construed as limiting the disclosure.

Figure 1:
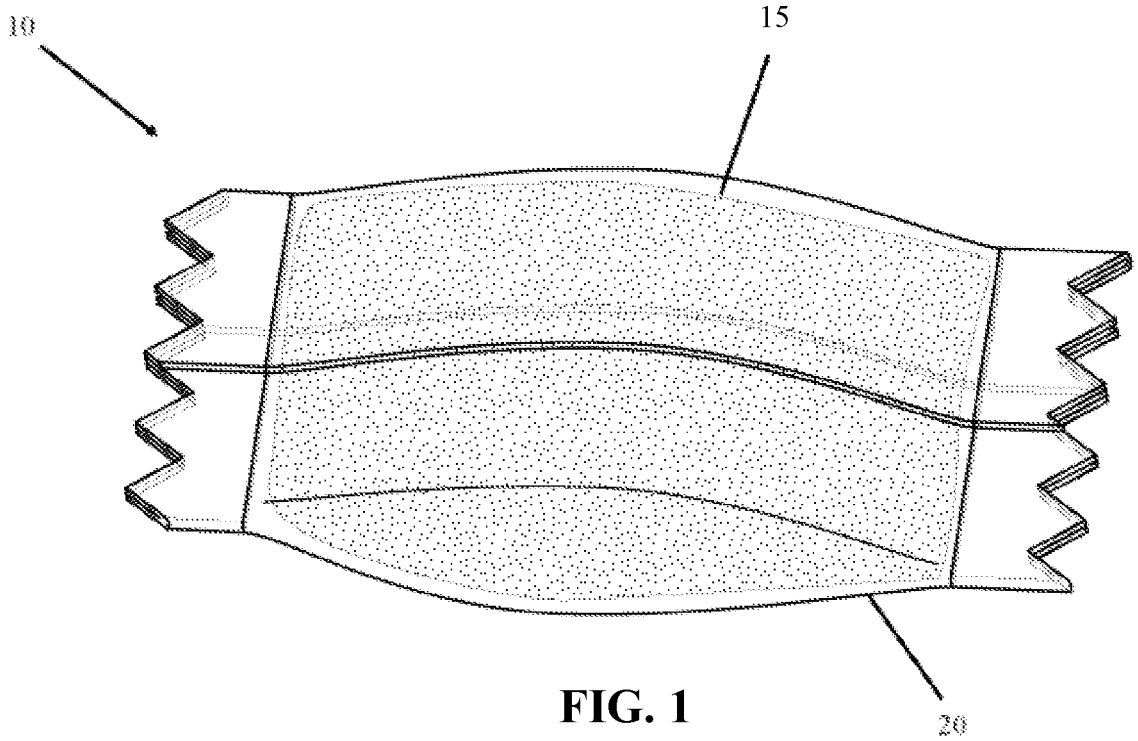
Figure 2:
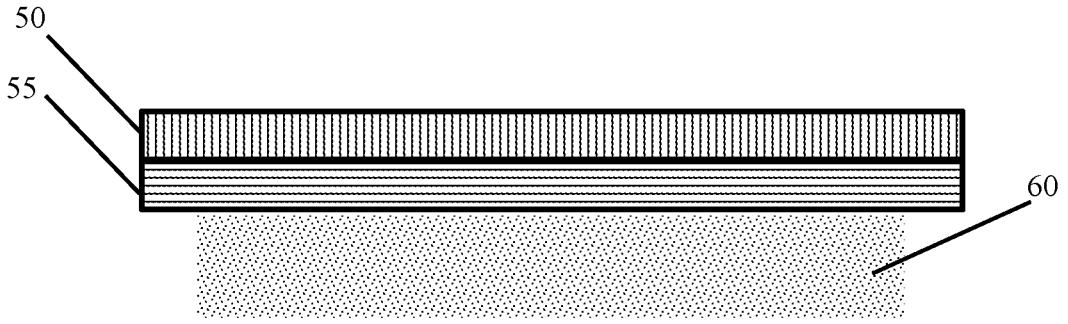
Figure 3:
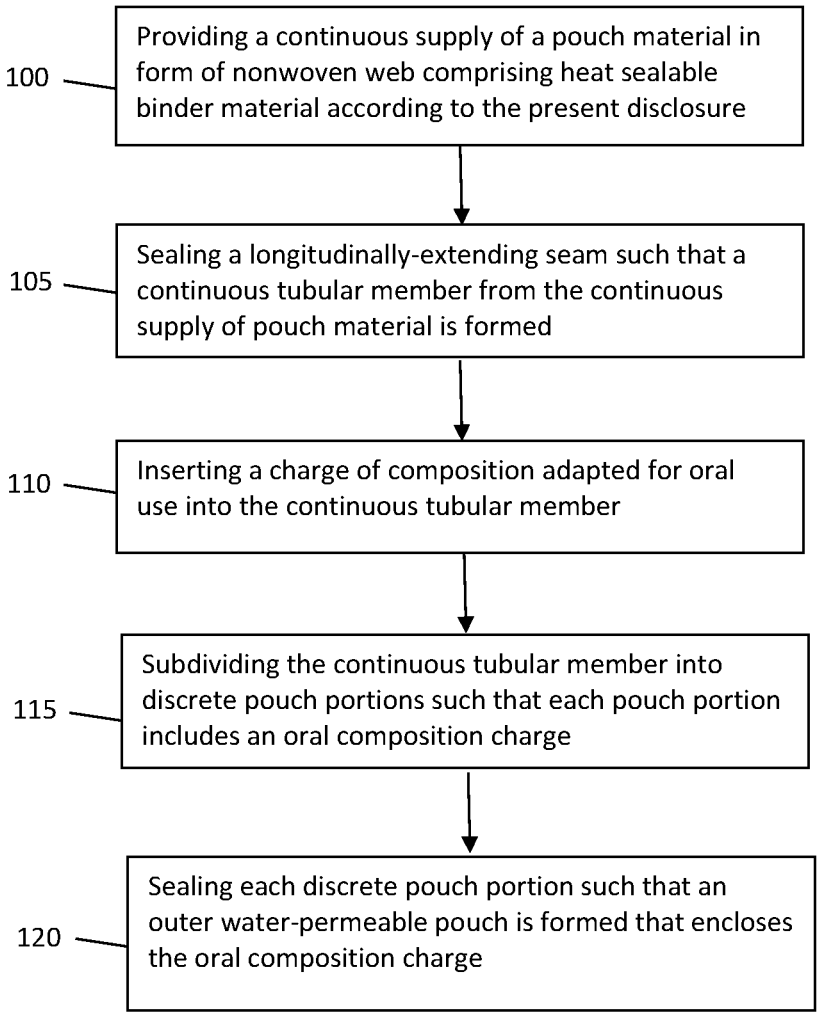

FIG. 1 is a front perspective view illustrating a pouched product according to an embodiment of the present disclosure;

FIG. 2 is a partial cross-sectional view illustrating a pouched product comprising a layered outer pouch, wherein the layered outer pouch comprises a hydrophilic material layer and a hydrophobic material layer; and FIG. 3 is a flow chart illustrating the general steps for manufacturing a pouched product according to an embodiment of the present disclosure.

DETAILED DESCRIPTION

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. As used in this specification and the claims, the singular forms "a," "an," and "the" include plural referents unless the context clearly dictates otherwise.

The disclosure generally provides products configured for oral use. The term "configured for oral use" as used herein means that the product is provided in a form such that during use, saliva in the mouth of the user causes one or more of the components of the mixture (e.g., flavoring agents and/or nicotine) to pass into the mouth of the user. In certain embodiments, the product is adapted to deliver components to a user through mucous membranes in the user's mouth and, in some instances, said component is an active ingredient (including, but not limited to, for example, nicotine) that can be absorbed through the mucous membranes in the mouth when the product is used.

In particular, the disclosure provides products in the form of a mixture of one or more components, disposed within a moisture-permeable container (e.g., a water-permeable pouch). Such mixtures in the water-permeable pouch format are typically used by placing a pouch containing the mixture in the mouth of a human subject/user. Generally, the pouch is placed somewhere in the oral cavity of the user, for example under the lips, in the same way as moist snuff products are generally used. The pouch preferably is not chewed or swallowed. Exposure to saliva then causes some of the components of the mixture therein (e.g., flavoring agents and/or nicotine) to pass through e.g., the water-permeable pouch and provide the user with flavor and satisfaction, and the user is not required to spit out any portion of the mixture. After about 10 minutes to about 60 minutes, typically about 15 minutes to about 45 minutes, of use/enjoyment, substantial amounts of the mixture have been ingested by the human subject, and the pouch may be removed from the mouth of the consumer for disposal. Preferred pouch materials for products described herein may be designed and manufactured such that under conditions of normal use, a significant amount of the contents of the formulation within the pouch permeate through the pouch material prior to the time that the pouch undergoes loss of its physical integrity.

For example, as illustrated in FIG. 1, an example pouched product 10 can comprise an outer water-permeable container 20 in the form of a pouch which contains a particulate mixture 15 adapted for oral use. The orientation, size, and type of outer water-permeable pouch and the type and nature of the composition adapted for oral use that are illustrated herein are not construed as limiting thereof.

In various embodiments, a moisture-permeable packet or pouch can act as a container for use of the composition within. For example, the pouch provides a liquid-permeable container of a type that may be considered to be similar in character to the mesh-like type of material that is used for the construction of a tea bag. If desired, flavoring ingredients, disintegration aids, and other desired components, may be incorporated within, or applied to, the pouch material. The composition/construction of such packets or pouches, such as the container pouch 20 in the embodiment illustrated in FIG. 1, may be varied as noted herein. For example, suitable packets, pouches or containers of the type used for the manufacture of smokeless tobacco products, which can be modified according to the present disclosure, are available under the tradenames CatchDry, Ettan, General, Granit, Goteborgs Rape, Grovsnus White, Metropol Kaktus, Mocca Anis, Mocca Mint, Mocca Wintergreen, Kicks, Probe, Prince, Skruf and TreAnkrare. A pouch type of product similar in shape and form to various embodiments of a pouched product described herein is commercially available as ZONNIC (distributed by Niconovum AB). Additionally, pouch type products generally similar in shape and form to various embodiments of a pouched product are set forth as snuff bag compositions E-J in Example 1 of PCT WO 2007/104573 to Axelsson et al., which is incorporated herein by reference, which are produced using excipient ingredients and processing conditions that can be used to manufacture pouched products as described herein.

Pouch Materials

The pouches of the present disclosure can be formed from a fleece material, e.g., fibrous nonwoven webs. As used herein, the term "fiber" is defined as a basic element of textiles. Fibers are often in the form of a rope- or string-like element. As used herein, the term "fiber" is intended to include fibers, filaments, continuous filaments, staple fibers, and the like. The term "multicomponent fibers" refers to fibers that comprise two or more components that are different by physical or chemical nature, including bicomponent fibers. Specifically, the term "multicomponent fibers" includes staple and continuous fibers prepared from two or more polymers present in discrete structured domains in the fiber, as opposed to blends where the domains tend to be dispersed, random or unstructured.

A "fleece material" as used herein may be formed from various types of fibers (e.g., cellulosic fibers; such as viscose fibers, regenerated cellulose fibers, cellulose fibers, and wood pulps; cotton fibers; other natural fibers; or polymer/synthetic-type fibers) capable of being formed into a traditional fleece fabrics or other traditional pouch materials. For example, fleece materials may be provided in the form of a woven or nonwoven fabric. Suitable types of fleece materials, for example, are described in U.S. Pat. No. 8,931,493 to Sebastian et al.; US Patent App. Pub. No. 2016/0000140 to Sebastian et al.; and US Patent App. Pub. No. 2016/0073689 to Sebastian et al.; which are all incorporated herein by reference.

The term "nonwoven" is used herein in reference to fibrous materials, webs, mats, batts, or sheets in which fibers are aligned in an undefined or random orientation. The nonwoven fibers are initially presented as unbound fibers or filaments. An important step in the manufacturing of nonwovens involves binding the various fibers or filaments together. The manner in which the fibers or filaments are bound can vary, and include thermal, mechanical and chemical techniques that are selected in part based on the desired characteristics of the final product, as discussed in more detail below.

In some embodiments, the fibers within the fleece material may include, but are not limited to, a polymer selected from the group consisting of polyglycolic acid, polylactic acid, polyhydroxyalkanoates, polycaprolactone, polybutylene succinate, polybutylene succinate adipate, and copolymers thereof. In some embodiments, the fibers within the fleece material may be selected from the groups consisting wool, cotton, fibers made of cellulosic material, such as regenerated cellulose, cellulose acetate, cellulose triacetate, cellulose nitrate, ethyl cellulose, cellulose acetate propionate, cellulose acetate butyrate, hydroxypropyl cellulose, methyl hydroxypropyl cellulose, protein fibers, and the like. See also, the fiber types set forth in US Pat. Appl. Pub. No. 2014/0083438 to Sebastian et al., which is incorporated by reference herein.

Regenerated cellulose fibers can be particularly advantageous, and are typically prepared by extracting non-cellulosic compounds from wood, contacting the extracted wood with caustic soda, followed by carbon disulfide and then by sodium hydroxide, giving a viscous solution. The solution is subsequently forced through spinneret heads to create viscous threads of regenerated fibers. Example methods for the preparation of regenerated cellulose are provided in U.S. Pat. No. 4,237,274 to Leoni et al; U.S. Pat. No. 4,268,666 to Baldini et al; U.S. Pat. No. 4,252,766 to Baldini et al.; U.S. Pat. No. 4,388,256 to Ishida et al.; U.S. Pat. No. 4,535,028 to Yokogi et al.; U.S. Pat. No. 5,441,689 to Laity; U.S. Pat. No. 5,997,790 to Vos et al.; and U.S. Pat. No. 8,177,938 to Sumnicht, which are incorporated herein by reference. The manner in which the regenerated cellulose is made is not limiting, and can include, for example, both the rayon and the TENCEL processes. Various suppliers of regenerated cellulose are known, including Lenzing (Austria), Cordenka (Germany), Aditya Birla (India), and Daicel (Japan).

The fibers used in the nonwoven web according to the present disclosure can vary, and include fibers having any type of cross-section, including, but not limited to, circular, rectangular, square, oval, triangular, and multilobal. In certain embodiments, the fibers can have one or more void spaces, wherein the void spaces can have, for example, circular, rectangular, square, oval, triangular, or multilobal cross-sections. As noted previously, the fibers can be selected from single-component (i.e., uniform in composition throughout the fiber) or multicomponent fiber types including, but not limited to, fibers having a sheath/core structure and fibers having an islands-in-the-sea structure, as well as fibers having a side-by-side, segmented pie, segmented cross, segmented ribbon, or tipped multilobal cross-sections.

The physical parameters of the fibers present in the nonwoven web can vary. For example the fibers used in the nonwoven web can have varying size (e.g., length, dpf) and crimp characteristics. In some embodiments, fibers used in the nonwoven web can be nano fibers, sub-micron fibers, and/or micron-sized fibers. In certain embodiments, fibers of the nonwoven webs useful herein can measure about 1.5 dpf to about 2.0 dpf, or about 1.6 dpf to about 1.90 dpf. In a preferred embodiment, each fiber can be a staple fiber. Each fiber length can measure about 35 mm to about 60 mm, or about 38 mm to about 55 mm, for example. In various embodiments, each fiber can measure about 4-10 crimps per cm, or about 5-8 crimps per cm. It can be advantageous for all fibers in the nonwoven web to have similar fiber size and crimp attributes to ensure favorable blending and orientation of the fibers in the nonwoven web.

The fibrous webs can have varying thicknesses, porosities and other parameters. The nonwoven web can be formed such that the fiber orientation and porosity of the pouched product formed therefrom can retain the composition adapted for oral use that is enclosed within the outer water-permeable pouch, but can also allow the flavors of the composition to be enjoyed by the consumer. For example, in some embodiments, the fibrous webs can have a basis weight of about 20 gsm to about 35 gsm, or about 25 gsm to about 30 gsm. In a preferred embodiment, the fibrous web can have a basis weight of about 28 gsm. Basis weight of a fabric can be measured using ASTM D3776/D3776M-09a (2013) (Standard Test Methods for Mass Per Unit Area (Weight) of Fabric), for example. In various embodiments, the fibrous web can have a thickness of about 0.1 mm to about 0.15 mm (e.g., about 0.11 mm). The fibrous web can have an elongation of about 70% to about 80%, e.g., about 78%. In some embodiments, the fibrous web can have a peak load of about 4 lbs. to about 8 lbs., e.g., about 5.5 lbs. Elongation and breaking strength of textile fabrics can be measured using ASTM D5034-09(2013) (Standard Test Method for Breaking Strength and Elongation of Textile Fabrics (Grab Test)), for example. In various embodiments, the fibrous web can have a Tensile Energy Absorption (TEA) of about 35 to about 40, e.g., about 37. In certain embodiments, the fibrous web can have a porosity of greater than about 10,000 ml/min/cm$^2$. TEA can be measured, for example, as the work done to break the specimen under tensile loading per lateral area of the specimen. Porosity, or air permeability of textile fabrics can be measured using ASTM D737-04(2012) (Standard Test method for Air Permeability of Textile Fabrics), for example.

In various embodiments of the pouched product described herein, the outer water-permeable pouch is made from a nonwoven web as described above. In some embodiments, pouch is constructed of a single layer of the nonwoven web. In various embodiments, the pouch material comprises a multilayer composite made up of two or more nonwoven layers. Each nonwoven layer can be formed by processes discussed above. In a multilayer structure, as illustrated in FIG. 2 for example, a first layer 50 can be relatively hydrophilic and a second layer 55 can be relatively hydrophobic (compared to each other). In some embodiments, an outer water-permeable pouch can comprise an outer hydrophilic layer 50 and an inner hydrophobic layer 55 that can be in contact with the composition adapted for oral use 60. As such, the hydrophobic layer can, during storage of the pouched product, retain any moisture in the composition adapted for oral use such that flavors in the composition are not lost due to moisture loss. However, capillaries in the hydrophobic layer can wick out moisture into the mouth of the user, such that flavors are released into the oral cavity when used. In this manner, the pouch material can enhance storage stability without significantly compromising the enjoyment of the product by the end user. In less preferred embodiments, the relatively hydrophilic layer could be located on the interior of the multi-layer structure. The two layers can be formed into a multi-layer composite nonwoven material using any means known in the art, such as by attaching the two layers together using adhesive or stitching. The hydrophobicity of a textile material can be evaluated, for example, by measuring the contact angles between a drop of liquid and the surface of a textile material, as is known in the art.

In certain embodiments, an outer hydrophilic layer can comprise a flavor component (such as any of the flavor components noted herein), which can be applied to the nonwoven layer in any conventional manner such as by coating, printing, and the like. In some embodiments, the flavor within an outer hydrophilic layer can differ from a flavor contained within the internal composition adapted for oral use. By having a hydrophobic layer between the inner composition and the outer hydrophilic layer, the different flavors can be prevented from blending because the hydrophobic layer can prevent moisture from leaving the inner composition until enough moisture from the mouth of the user overwhelms the hydrophobic layer and thereby allows moisture to enter and leave the inner area of the pouched product where the composition is housed. By the time this takes place, the flavor component of the outer hydrophilic layer can have dissipated. In this manner, the product can be designed to provide multiple, different sensory experiences, a first sensory experience where the flavor in the outer layer transitions into the mouth of the user and a second sensory experience, typically occurring later in time, where the flavor of the internal composition transitions into the mouth of the user.

The hydrophilic and hydrophobic layers can be formed from similar nonwoven web compositions, but one of the nonwoven webs can be treated to enhance either hydrophobicity or hydrophilicity. For example, a layer of the nonwoven web can be treated with a wet chemical solution to confer hydrophilicity thereupon. In one such process, a nonwoven web layer is treated with an aqueous alcohol solution containing a food-grade surfactant. The surfactant may include, for example one or more of sorbitan aliphatic acid ester, polyglycerin aliphatic acid ester, or sucrose aliphatic acid ester (see, e.g., U.S. Pat. No. 7,498,281 to Iwasaki et al., which is incorporated herein by reference). In some embodiments, the fleece fabric layers can be made hydrophilic or hydrophobic by changing the cellulose fiber chosen. For example, predominantly hydrophobic cellulose fibers are commercially available as Tencel® Biosoft from Lenzing of Austria and as Olea Fiber from Kelheim of Germany. In various embodiments, the hydrophilic layer can incorporate cationic or anionic cellulose fibers that are also available from Kelheim of Germany, for example. The hydrophilic layer can contain additives such as polyethylene glycols, methyl cellulose, hydroxypropylmethyl cellulose, hydroxypropyl cellulose, hydroxypropylmethyl cellulose phthalate, polyvinyl pyrrolidone, polyvinyl alcohol, polyacrylic acids, gelatins, alginates, sulfosuccinates, and combinations thereof.

In some embodiments, a heat sealable binder coating or a binder material (e.g., a coating or other additive) may be added to the fibers prior to, during, or after forming the fleece material. As used herein, "heat sealable binder coatings" refers to coating materials, such as acrylic polymer compositions, applied to a substrate (e.g., a nonwoven web or fleece material) and which are capable of sealing seams of individual pouches upon heating. In some embodiments, a binder material can be added to the web fibers before or during the laying of the fibrous web (i.e., before the fibrous web is bonded to form a fleece material). In certain embodiments, a binder material can be added to the fleece material after it has been formed. For example, in some embodiments, the binder material is added to the fleece material pre-drying.

In various embodiments, the binder material is in the form of a liquid coating. In certain embodiments, a binding powder can be applied to the fleece material. For example, powdered polyethylene can be used as a binder material. The liquid or powder coating can be applied, for example, between layers of fibers when cross-laying, air laying, or as an after treatment. A short exposure in an oven is sufficient to melt and fuse the binder material.

In various embodiments, the binder material can include an acrylic polymer (also referred to as an acrylate polymer, an acrylic, or a polyacrylate). Acrylate monomers, used to form acrylate polymers, are based on the structure of acrylic acid, which consists of a vinyl group and a carboxylic acid ester terminus. Other common acrylate monomers are derivatives of acrylic acid. Various derivatives are known. For example, methyl methacrylate is a derivative of acrylic acid in which one vinyl hydrogen and the carboxylic acid hydrogen are both replaced by methyl groups. Acrylonitrile is a derivative of acrylic acid in which the carboxylic acid group is replaced by the related nitrile group. Other acrylate monomers known in the art can be used to form acrylate polymers that can be used in a binder material according to the present disclosure.

The binder material can include an aliphatic polyester. Aliphatic polyesters can be particularly useful because of the biodegradable nature thereof. In addition to biodegradability, aliphatic polyesters, particularly polylactic acid, can impart other desirable properties to the fleece materials of the present disclosure. For example, a binder material which includes polylactic acid (or a further aliphatic polyester) as a component can exhibit improved hydrophilic properties and/or improved flame retardant capabilities. Examples of aliphatic polyesters which may be useful in the present disclosure include, without limitation, polymers formed from (1) a combination of glycol (e.g., ethylene, glycol, propylene glycol, butylene glycol, hexanediol, octanediol or decanediol) or an oligomer of ethylene glycol (e.g., diethylene glycol or triethylene glycol) with an aliphatic dicarboxylic acid (e.g., succinic acid, adipic acid, hexanedicarboxylic acid or decaneolicarboxylic acid) or (2) the self-condensation of hydroxy carboxylic acids other than polylactic acid, such as polyhydroxy butyrate, polyethylene adipate, polybutylene adipate, polyhexane adipate, and copolymers containing them. Examples of aliphatic polyesters include, but are not limited to, polyglycolide or polyglycolic acid (PGA), polylactide or polylactic acid (PLA), polycaprolactone (PCL), polyethylene adipate (PEA), polyhydroxyalkonoate (PHA), polyhydroxybutyrate (PHB), poly (3-hydroxybutyrate-co-3-hydroxyvalerate) (PHBV), and polylactide-co-glycolide.

The heat sealable binder materials described herein can advantageously exhibit a melting point in a relatively low range to facilitate heat sealing of the pouch material while promoting degradability after use. For example, the binder material according to the present disclosure can have a melting point of about 300° C. or less, 250° C. or less, about 200° C. or less, about 180° C. or less, about 150° C. or less, about 140° C. or less, about 120° C. or less, or about 100° C. or less. In various embodiments, the binder material according to the present disclosure can have a melting point in the range of about 50° C. to about 300° C., about 120° C. to about 280° C., about 150° C. to about 250° C., about 50° C. to about 200° C., or about 65° C. to about 150° C. The melting point of the binder materials described herein can be above conventional storage and transportation temperatures of the final pouched product. The melting point of the binder materials can also be above the temperature inside a user's mouth such that the pouched product does not fall apart during use.

Melting points of various polymers are known in the art and can be modified in varying ways to obtain a binder material with a melting point in the desired temperature range. For example, as described above, the binder material can include a thermoplastic polymer with a low melting point. In various embodiments, a melt flow index measurement is used to define a polymer. The ability of a polymer component to flow at a temperature is related to crystallinity, molecular weight, and the possible presence of plasticizers, for example. Tests known in the art can be used to measure the melt flow index of a polymer component. For example, melt flow test ASTM D1238 can be used to determine the melt flow index of a polymer component.

The degree of crystallinity of a polymer is based on the regularity of the polymer backbone and its ability to line up with similarly shaped sections of itself or other chains. As is known in the art, a polymer enantiomer is one of two stereoisomers that are mirror images of each other. By polymerizing a particular enantiomer or by using a mixture of the two enantiomers, it is possible to prepare polymers that are chemically similar yet which have significantly differing properties. In particular, it has been found that by modifying the stereochemistry of certain polymers, it is possible to control the melting characteristics of the polymer. Specifically, by copolymerizing one enantiomer with the other, the polymer backbone generally becomes irregularly shaped enough that it cannot line up and orient itself with other backbone segments of pure single-enantiomer polymer, thus reducing the crystallinity of the polymer, which in turn can decrease the bonding temperature (e.g., melting point) at which the polymer forms satisfactory bonds. In various embodiments, the inclusion of a nucleating agent can increase the crystallinity of a polymer component.

Additionally, binder materials can be defined by their molecular weight and binder materials may be selected according to the present disclosure based on the molecular weight of the binder material to provide a binder material with a melting point within the desired temperature range. In various embodiments, the binder material can have a melting point in the range of about 10,000-500,000 g/mol, about 100,000-250,000 g/mol, or about 50,000-150,000 g/mol. In certain embodiments, the binder material can include a thermoplastic polymer and molecular weight can refer to the length of each polymer chain. While a difference in molecular weight can be inherent to the polymer grade, in various embodiments, a polymer component can comprise an additive which causes a reduction of the polymer's molecular weight. In various embodiments, the additive can cause a reduction in the polymer component's molecular weight of about 5% or greater, about 10% or greater, or about 15% or greater.

A non-limiting example of an additive that can be utilized according to the present disclosure is pentaerythritol, which can be added to a polymer component prior to or during extrusion (e.g., wherein the additive can be added into the polymer component to form a compound). Pentaerythritol reduces the molecular weight of condensation polymers such as esters by hydrolysis. In preferred embodiments, the first polymer component can be blended with about 0.5% to about 8% by weight or about 1.5% to about 4.5% by weight of pentaerythritol prior to or during extrusion. Other, non-limiting examples of additives that can be included in a polymer component to reduce the molecular weight of the polymer component include water, sodium hydroxide, hydrated alumina trihydrate, ethylene glycol, and the like.

In some embodiments, an additive can be utilized that improves bonding performance of a polymeric binder material without necessarily reducing the molecular weight of the polymer component. For example, plasticizers such as an aliphatic diester and/or a polyhydroxyalkanoate ("PHA") can be included in a binder material polymer component. Such additives can be blended with a polymer component prior to or during extrusion.

As is known in the art, conventional binder materials are very thermostable under environmental conditions, which can inhibit biodegradation of conventional pouched products. Low melting points of certain binder materials disclosed herein can provide enhanced biodegradability of the fleece materials. In various embodiments of the present disclosure, biodegradable fibers can be selected for forming the fleece materials described herein (e.g., biodegradable polymer fibers and/or biodegradable cellulose fibers). The biodegradable fibers can be used in combination with a low melting point binder material, for example, to further enhance biodegradability of the pouch material. Biodegradability can be measured, for example, by placing a sample in environmental conditions expected to lead to decomposition, such as placing a sample in water, a microbe-containing solution, a compost material, or soil. The degree of degradation can be characterized by weight loss of the sample over a given period of exposure to the environmental conditions. U.S. Pat. No. 5,970,988 to Buchanan et al. and U.S. Pat. No. 6,571,802 to Yamashita provide example test conditions for degradation testing. The degradability of a plastic material also may be determined using one or more of the following ASTM test methods: D5338, D5526, D5988, and D6400.

The present disclosure is directed, in particular, to selecting or modifying the binder material of a fleece material to promote biodegradability of a pouched product comprising the fleece material, by ensuring that the binder material has a lower melting point than conventional binders used in the preparation of fleece pouch materials. However, it is also noted that there may be certain advantages associated with the use, instead, of a binder material which has a higher melting point than conventional binders used in fleece pouch material preparation. Without being limited by theory, binders with a higher melting point can provide for a stronger seal at the pouch seams. For example, the present disclosure also provides for binders and products and methods associated with such binders which exhibit higher melting points (e.g., a melting point of about 450° C. or greater) and which can, in some embodiments, provide fleeces and pouched products with enhanced strength properties. High melting point binder materials according to the present disclosure can have a melting point, for example, of about 300° C. or greater, about 400° C. or greater, about 450° C. or greater, about 550° C. or greater, or about 600° C. or greater. In certain embodiments, high melting point binder materials according to the present disclosure can have a melting point in the range of about 300° C. to about 750° C., 300° C. to about 600° C., about 450° C. to about 600° C., or about 500° C. to about 600° C. In various embodiments, a high melting point binder material can comprise a polyester, a nylon, or a combination thereof.

Method of Producing a Nonwoven Web Pouch Material

The means of producing the nonwoven web can vary. Web formation can be accomplished by any means known in the art. Web formation will typically involve a carding step, which involves deposition of the fibers onto a surface followed by aligning/blending the fibers in a machine direction. Thereafter, the fibrous web is typically subjected to some type of bonding/entanglement including, but not limited to, thermal fusion or bonding, mechanical entanglement, chemical adhesive, or a combination thereof. In one embodiment, the fibrous web is bonded thermally using a calendar (which can provide flat or point bonding), steam jet bonding, or a thru-air oven. Additional bonding methods include ultrasonic bonding and crimping. In some embodiments, needle punching is utilized, wherein needles are used to provide physical entanglement between fibers. In one embodiment, the web is entangled using hydroentanglement, which is a process used to entangle and bond fibers using hydrodynamic forces. As noted above, a binder material can be applied to the fibers of the fibrous web before laying the fibrous web, during formation of the fibrous web, and/or after the fibrous web has been bonded to form a fleece material. After forming the fleece material, heat can be applied to the fleece material in order to activate/at least partially melt the binder material to further bond the fleece material and thereby further enhance the mechanical integrity of the fleece material.

Methods for forming a nonwoven web comprising natural and synthetic fibers may include drylaid, airlaid and wetlaid methods. In some embodiments, the nonwoven fabric can be formed using a spunlaid or spunmelt process, which includes both spunbond and meltblown processes, wherein such processes are understood to typically entail melting, extruding, collecting and bonding thermoplastic polymer materials to form a fibrous nonwoven web. The technique of meltblowing is known in the art and is discussed in various patents, for example, U.S. Pat. No. 3,849,241 to Butin, U.S. Pat. No. 3,987,185 to Buntin et al., U.S. Pat. No. 3,972,759 to Buntin, and U.S. Pat. No. 4,622,259 to McAmish et al., each of which is herein incorporated by reference in its entirety. General spunbonding processes are described, for example, in U.S. Pat. No. 4,340,563 to Appel et al., U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartmann, and 30 U.S. Pat. No. 3,542,615 to Dobo et al., which are all incorporated herein by reference.

In various embodiments, the nonwoven web is made by providing a dry laid or a spun laid web of fibers, and then needle punching the web to bond the dry laid or spun laid web. The needle punched fleece material is produced when barbed needles are pushed through the fibrous web, forcing some fibers upwards or downwards through the web by the barbed needles. The fibers punched through the web remain at their new position once the needles are withdrawn. This needling action interlocks fibers and holds the structure together by inter fiber friction forces caused by compression of the web, thereby bonding the web. By displacing a sufficient number of fibers in the web, the web is converted into a nonwoven fabric.

In certain embodiments, the nonwoven web is made by a fleece carding process with point bonding. The point bonding (e.g., using a calendar) should be limited to a relatively small portion of the surface area of the nonwoven web to maintain good porosity in the web for migration of water-soluble components through the web during oral use. In certain embodiments, the point bonding is limited to less than about 60% of the surface area of the nonwoven web (or resulting pouch), such as less than about 50%, less than about 30%, or less than about 20% (e.g., about 1% to about 50%, about 5% to about 40%, or about 10% to about 30%). An advantage of point bonding is the ability to control the porosity, flexibility and fabric strength.

In other embodiments, the nonwoven web can be subjected to hydroentangling. The term "hydroentangled" or "spunlaced" as applied to a nonwoven fabric herein defines a web subjected to impingement by a curtain of high speed, fine water jets, typically emanating from a nozzle jet strip accommodated in a pressure vessel often referred to as a manifold or an injector. This hydroentangled fabric can be characterized by reoriented, twisted, turned and entangled fibers. For example, the fibers can be hydroentangled by exposing the nonwoven web to water pressure from one or more hydroentangling manifolds at a water pressure in the range of about 10 bar to about 1000 bar. As compared to point bonding, spunlace technology, in certain embodiments, will have less impact on porosity of the web and, thus, may enhance flavor transfer through the nonwoven pouch material.

In various embodiments, the nonwoven web can be subjected to a second bonding method in order to reduce elongation of the web during processing. In certain embodiments, nonwoven webs of the present disclosure can exhibit significant elongation during high speed processing on pouching equipment. Too much elongation of the nonwoven web can cause the web to shrink during processing, such that the final product is not sized appropriately. As such, it can be necessary to modify process equipment to fit a wider roll of fleece, for example, to compensate for any shrinkage in the final product due to elongation.

In order to avoid or at least reduce such an elongation problem, in various embodiments the nonwoven web can be point bonded after the first bonding (e.g., hydroentangling) is completed. A second bonding process can increase the tensile strength of the nonwoven web and reduce elongation characteristics. In particular, a point bonding process can bond a nonwoven web by partially or completely melting the web (e.g., the heat sealable binder material) at discrete points. For example, in some embodiments, the nonwoven web can be subjected to ultrasonic bonding after initial bonding of the web. Any ultrasonic bonding system for nonwoven materials known in the art can be used to ultrasonically bond the nonwoven web. See, for example, the apparatuses and devices disclosed in U.S. Pat. No. 8,096,339 to Aust and U.S. Pat. No. 8,557,071 to Weiler, incorporated by reference herein. In some embodiments, the nonwoven web can be subjected to point bonding via embossed and/or engraved calendar rolls, which are typically heated. See, e.g., the point bonding methods incorporating the use of very high calendar pressures and embossing techniques discussed in U.S. Pat. Publ. No. 2008/0249492 to Schmidt, herein incorporated by reference in its entirety. The point bonding process is typically limited to less than about 60% of the surface area of the nonwoven web as noted above.

In certain embodiments, the processing techniques used to blend, entangle and bond the nonwoven web can also impart a desired texture to the fibrous nonwoven web material. For instance, point bonding or hydroentangling can impart a desired texture (e.g. a desired pattern) to the nonwoven web. This textured pattern can include product identifying information. In some embodiments, the product identifying information is selected from the group consisting of product brand, a company name, a corporate logo, a corporate brand, a marketing message, product strength, active ingredient, product manufacture date, product expiration date, product flavor, product release profile, weight, product code (e.g., batch code), other product differentiating markings, and combinations thereof.

Composition within the Pouch

Pouched products generally comprise, in addition to the pouch-based exterior, a mixture within the pouch that typically comprises one or more active ingredients and/or one or more flavorants, and various other optional ingredients. The composition of the material within the pouches provided herein is not particularly limited, and can comprise any filling composition, including those included within conventional pouched produces. Such compositions are generally mixtures of two or more components and as such, the compositions are, in some cases, referenced herein below as "mixtures." Certain components that can advantageously be included in the mixtures within certain embodiments of the pouches provided herein are outlined generally below; however, it is to be understood that the discussion below is not intended to be limiting of the components that can be incorporated within the disclosed pouches.

Filler Component

The material within the pouches as described herein typically includes at least one particulate filler component. Such particulate filler components may fulfill multiple functions, such as enhancing certain organoleptic properties such as texture and mouthfeel, enhancing cohesiveness or compressibility of the product, and the like. Generally, the filler components are particulate materials and are cellulose-based. For example, suitable particulate filler components are any non-tobacco plant material or derivative thereof, including cellulose materials derived from such sources. Examples of cellulosic non-tobacco plant material include cereal grains (e.g., maize, oat, barley, rye, buckwheat, and the like), sugar beet (e.g., FIBREX® brand filler available from International Fiber Corporation), bran fiber, and mixtures thereof. Non-limiting examples of derivatives of non-tobacco plant material include starches (e.g., from potato, wheat, rice, corn), natural cellulose, and modified cellulosic materials. Additional examples of potential particulate filler components include maltodextrin, dextrose, calcium carbonate, calcium phosphate, lactose, mannitol, xylitol, and sorbitol. Combinations of fillers can also be used.

"Starch" as used herein may refer to pure starch from any source, modified starch, or starch derivatives. Starch is present, typically in granular form, in almost all green plants and in various types of plant tissues and organs (e.g., seeds, leaves, rhizomes, roots, tubers, shoots, fruits, grains, and stems). Starch can vary in composition, as well as in granular shape and size. Often, starch from different sources has different chemical and physical characteristics. A specific starch can be selected for inclusion in the mixture based on the ability of the starch material to impart a specific organoleptic property to composition. Starches derived from various sources can be used. For example, major sources of starch include cereal grains (e.g., rice, wheat, and maize) and root vegetables (e.g., potatoes and cassava). Other examples of sources of starch include acorns, arrowroot, arracacha, bananas, barley, beans (e.g., favas, lentils, mung beans, peas, chickpeas), breadfruit, buckwheat, canna, chestnuts, colacasia, katakuri, kudzu, malanga, millet, oats, oca, Polynesian arrowroot, sago, sorghum, sweet potato, quinoa, rye, tapioca, taro, tobacco, water chestnuts, and yams. Certain starches are modified starches. A modified starch has undergone one or more structural modifications, often designed to alter its high heat properties. Some starches have been developed by genetic modifications, and are considered to be "genetically modified" starches. Other starches are obtained and subsequently physically (e.g., heat, cool water swelling, etc.), chemically, or enzymatically modified. For example, modified starches can be starches that have been subjected to chemical reactions, such as esterification, etherification, oxidation, depolymerization (thinning) by acid catalysis or oxidation in the presence of base, bleaching, transglycosylation and depolymerization (e.g., dextrinization in the presence of a catalyst), cross-linking, acetylation, hydroxypropylation, and/or partial hydrolysis. Enzymatic treatment includes subjecting native starches to enzyme isolates or concentrates, microbial enzymes, and/or enzymes native to plant materials, e.g., amylase present in corn kernels to modify corn starch. Other starches are modified by heat treatments, such as pregelatinization, dextrinization, and/or cold water swelling processes. Certain modified starches include monostarch phosphate, distarch glycerol, distarch phosphate esterified with sodium trimetaphosphate, phosphate distarch phosphate, acetylated distarch phosphate, starch acetate esterified with acetic anhydride, starch acetate esterified with vinyl acetate, acetylated distarch adipate, acetylated distarch glycerol, hydroxypropyl starch, hydroxypropyl distarch glycerol, starch sodium octenyl succinate.

In some embodiments, the particulate filler component is a cellulose material or cellulose derivative. One particularly suitable particulate filler component for use in the products described herein is microcrystalline cellulose ("MCC"). The MCC may be synthetic or semi-synthetic, or it may be obtained entirely from natural celluloses. The MCC may be selected from the group consisting of AVICEL® grades PH-100, PH-102, PH-103, PH-105, PH-112, PH-113, PH-200, PH-300, PH-302, VIVACEL® grades 101, 102, 12, 20 and EMOCEL® grades 50M and 90M, and the like, and mixtures thereof. In one embodiment, the mixture comprises MCC as the particulate filler component. The quantity of MCC present in the mixture as described herein may vary according to the desired properties.

The amount of particulate filler component can vary, but is typically up to about 75 percent of the material contained within the pouch by weight (i.e., the mixture), based on the total weight of the mixture. A typical range of particulate filler material (e.g., MCC) within the mixture can be from about 10 to about 75 percent by total weight of the mixture, for example, from about 10, about 15, about 20, about 25, or about 30, to about 35, about 40, about 45, or about 50 weight percent (e.g., about 20 to about 50 weight percent or about 25 to about 45 weight percent). In certain embodiments, the amount of particulate filler material is at least about 10 percent by weight, such as at least about 20 percent, or at least about 25 percent, or at least about 30 percent, or at least about 35 percent, or at least about 40 percent, based on the total weight of the mixture.

In one embodiment, the particulate filler component further comprises a cellulose derivative or a combination of such derivatives. In some embodiments, the mixture comprises from about 1 to about 10% of the cellulose derivative by weight, based on the total weight of the mixture, with certain embodiments comprising about 1 to about 5% by weight of cellulose derivative. In certain embodiments, the cellulose derivative is a cellulose ether (including carboxyalkyl ethers), meaning a cellulose polymer with the hydrogen of one or more hydroxyl groups in the cellulose structure replaced with an alkyl, hydroxyalkyl, or aryl group. Non-limiting examples of such cellulose derivatives include methylcellulose, hydroxypropylcellulose ("HPC"), hydroxypropylmethylcellulose ("HPMC"), hydroxyethyl cellulose, and carboxymethylcellulose ("CMC"). In one embodiment, the cellulose derivative is one or more of methylcellulose, HPC, HPMC, hydroxyethyl cellulose, and CMC. In one embodiment, the cellulose derivative is HPC. In some embodiments, the mixture comprises from about 1 to about 3% HPC by weight, based on the total weight of the mixture.

Water

The water content of the mixture within the pouched product described herein, prior to use by a consumer of the product, may vary according to the desired properties. Typically, the mixture, as present within the product prior to insertion into the mouth of the user, is less than about 60 percent by weight of water, and generally is from about 1 to about 60% by weight of water, for example, from about 5 to about 55, about 10 to about 50, about 20 to about 45, or about 25 to about 40 percent water by weight, including water amounts of at least about 5% by weight, at least about 10% by weight, at least about 15% by weight, and at least about 20% by weight.

Flavoring Agent

As used herein, a "flavoring agent" or "flavorant" is any flavorful or aromatic substance capable of altering the sensory characteristics associated with the oral product. Examples of sensory characteristics that can be modified by the flavoring agent include taste, mouthfeel, moistness, coolness/heat, and/or fragrance/aroma. Flavoring agents may be natural or synthetic, and the character of the flavors imparted thereby may be described, without limitation, as fresh, sweet, herbal, confectionary, floral, fruity, or spicy. Specific types of flavors include, but are not limited to, vanilla, coffee, chocolate/cocoa, cream, mint, spearmint, menthol, peppermint, wintergreen, eucalyptus, lavender, cardamon, nutmeg, cinnamon, clove, cascarilla, sandalwood, honey, jasmine, ginger, anise, sage, licorice, lemon, orange, apple, peach, lime, cherry, strawberry, trigeminal sensates, melatonin, terpenes, and any combinations thereof. See also, Leffingwell et al., Tobacco Flavoring for Smoking Products, R. J. Reynolds Tobacco Company (1972), which is incorporated herein by reference. Flavorings also may include components that are considered moistening, cooling or smoothening agents, such as eucalyptus. These flavors may be provided neat (i.e., alone) or in a composite, and may be employed as concentrates or flavor packages (e.g., spearmint and menthol, orange and cinnamon; lime, pineapple, and the like). Representative types of components also are set forth in U.S. Pat. No. 5,387,416 to White et al.; US Pat. App. Pub. No. 2005/0244521 to Strickland et al.; and PCT Application Pub. No. WO 05/041699 to Quinter et al., each of which is incorporated herein by reference. In some instances, the flavoring agent may be provided in a spray-dried form or a liquid form.

The flavoring agent generally comprises at least one volatile flavor component. As used herein, "volatile" refers to a chemical substance that forms a vapor readily at ambient temperatures (i.e., a chemical substance that has a high vapor pressure at a given temperature relative to a nonvolatile substance). Typically, a volatile flavor component has a molecular weight below about 400 Da, and often include at least one carbon-carbon double bond, carbon-oxygen double bond, or both. In one embodiment, the at least one volatile flavor component comprises one or more alcohols, aldehydes, aromatic hydrocarbons, ketones, esters, terpenes, terpenoids, or a combination thereof. Non-limiting examples of aldehydes include vanillin, ethyl vanillin, p-anisaldehyde, hexanal, furfural, isovaleraldehyde, cuminaldehyde, benzaldehyde, and citronellal. Non-limiting examples of ketones include 1-hydroxy-2-propanone and 2-hydroxy-3-methyl-2-cyclopentenone-1-one. Non-limiting examples of esters include allyl hexanoate, ethyl heptanoate, ethyl hexanoate, isoamyl acetate, and 3-methylbutyl acetate. Non-limiting examples of terpenes include sabinene, limonene, gamma-terpinene, beta-farnesene, nerolidol, thujone, myrcene, geraniol, nerol, citronellol, linalool, and eucalyptol. In one embodiment, the at least one volatile flavor component comprises one or more of ethyl vanillin, cinnamaldehyde, sabinene, limonene, gamma-terpinene, beta-farnesene, or citral. In one embodiment, the at least one volatile flavor component comprises ethyl vanillin.

The amount of flavoring agent utilized in the mixture can vary, but is typically up to about 10 weight percent, and certain embodiments are characterized by a flavoring agent content of at least about 0.1 weight percent, such as about 0.5 to about 10 weight percent, about 1 to about 6 weight percent, or about 2 to about 5 weight percent, based on the total weight of the mixture.

The amount of flavoring agent present within the mixture may vary over a period of time (e.g., during a period of storage after preparation of the mixture). For example, certain volatile components present in the mixture may evaporate or undergo chemical transformations, leading to a reduction in the concentration of one or more volatile flavor components. In one embodiment, a concentration of one or more of the at least one volatile flavor components present is greater than a concentration of the same one or more volatile flavor components present in a control pouched product which does not include the one or more organic acids, after the same time period. Without wishing to be bound by theory, it is believed that the same mechanisms responsible for loss of whiteness result in a gradual decline in certain volatile components in the flavoring (e.g., aldehydes, ketones, terpenes). Therefore, a decline in the presence of these volatile components leading to the discoloration over time may be expected to diminish the sensory satisfaction associated with products subject to such a degradation process.

Salts

In some embodiments, the mixture may further comprise a salt (e.g., alkali metal salts), typically employed in an amount sufficient to provide desired sensory attributes to the mixture. Non-limiting examples of suitable salts include sodium chloride, potassium chloride, ammonium chloride, flour salt, and the like. When present, a representative amount of salt is about 0.5 percent by weight or more, about 1.0 percent by weight or more, or at about 1.5 percent by weight or more, but will typically make up about 10 percent or less of the total weight of the mixture, or about 7.5 percent or less or about 5 percent or less (e.g., about 0.5 to about 5 percent by weight).

Sweeteners

The mixture typically further comprises one or more sweeteners. The sweeteners can be any sweetener or combination of sweeteners, in natural or artificial form, or as a combination of natural and artificial sweeteners. Examples of natural sweeteners include isomaltulose, fructose, sucrose, glucose, maltose, mannose, galactose, lactose, *stevia*, honey, and the like. Examples of artificial sweeteners include sucralose, maltodextrin, saccharin, aspartame, acesulfame K, neotame and the like. In some embodiments, the sweetener comprises one or more sugar alcohols. Sugar alcohols are polyols derived from monosaccharides or disaccharides that have a partially or fully hydrogenated form. Sugar alcohols have, for example, about 4 to about 20 carbon atoms and include erythritol, arabitol, ribitol, isomalt, maltitol, dulcitol, iditol, mannitol, xylitol, lactitol, sorbitol, and combinations thereof (e.g., hydrogenated starch hydrolysates). When present, a representative amount of sweetener may make up from about 0.1 to about 20 percent or more of the of the mixture by weight, for example, from about 0.1 to about 1%, from about 1 to about 5%, from about 5 to about 10%, or from about 10 to about 20% of the mixture on a weight basis, based on the total weight of the mixture.

Binding Agents

A binder (or combination of binders) may be employed in certain embodiments, in amounts sufficient to provide the desired physical attributes and physical integrity to the mixture. Binders also often function as thickening or gelling agents. Typical binders can be organic or inorganic, or a combination thereof. Representative binders include modified cellulose, povidone, sodium alginate, starch-based binders, pectin, carrageenan, pullulan, zein, and the like, and combinations thereof. In some embodiments, the binder comprises pectin or carrageenan or combinations thereof.

A binder may be employed in amounts sufficient to provide the desired physical attributes and physical integrity to the mixture. The amount of binder utilized in the mixture can vary, but is typically up to about 30 weight percent, and certain embodiments are characterized by a binder content of at least about 0.1% by weight, such as about 1 to about 30% by weight, or about 5 to about 10% by weight, based on the total weight of the mixture.

In certain embodiments, the binder includes a gum, for example, a natural gum. As used herein, a natural gum refers to polysaccharide materials of natural origin that have binding properties, and which are also useful as a thickening or gelling agents. Representative natural gums derived from plants, which are typically water soluble to some degree, include xanthan gum, guar gum, gum arabic, ghatti gum, gum tragacanth, karaya gum, locust bean gum, gellan gum, and combinations thereof. When present, natural gum binder materials are typically present in an amount of up to about 5% by weight, for example, from about 0.1, about 0.2, about 0.3, about 0.4, about 0.5, about 0.6, about 0.7, about 0.8, about 0.9, or about 1%, to about 2, about 3, about 4, or about 5% by weight, based on the total weight of the mixture.

Humectants

In certain embodiments, one or more humectants may be employed in the mixture. Examples of humectants include, but are not limited to, glycerin, propylene glycol, and the like. Where included, the humectant is typically provided in an amount sufficient to provide desired moisture attributes to the mixture. Further, in some instances, the humectant may impart desirable flow characteristics to the mixture for depositing in a mold. When present, a humectant will typically make up about 5% or less of the weight of the mixture (e.g., from about 0.5 to about 5% by weight). When present, a representative amount of humectant is about 0.1% to about 1% by weight, or about 1% to about 5% by weight, based on the total weight of the mixture.

Buffering Agents

In certain embodiments, the mixture of the present disclosure can comprise pH adjusters or buffering agents. Examples of pH adjusters and buffering agents that can be used include, but are not limited to, metal hydroxides (e.g., alkali metal hydroxides such as sodium hydroxide and potassium hydroxide), and other alkali metal buffers such as metal carbonates (e.g., potassium carbonate or sodium carbonate), or metal bicarbonates such as sodium bicarbonate, and the like. Where present, the buffering agent is typically present in an amount less than about 5 percent based on the weight of the mixture, for example, from about 0.5% to about 5%, such as, e.g., from about 0.75% to about 4%, from about 0.75% to about 3%, or from about 1% to about 2% by weight, based on the total weight of the mixture. Non-limiting examples of suitable buffers include alkali metals acetates, glycinates, phosphates, glycerophosphates, citrates, carbonates, hydrogen carbonates, borates, or mixtures thereof.

Colorants

A colorant may be employed in amounts sufficient to provide the desired physical attributes to the mixture. Examples of colorants include various dyes and pigments, such as caramel coloring and titanium dioxide. The amount of colorant utilized in the mixture can vary, but when present is typically up to about 3 weight percent, such as from about 0.1%, about 0.5%, or about 1%, to about 3% by weight, based on the total weight of the mixture.

Active Ingredient

The composition as disclosed herein includes one or more active ingredients. As used herein, an "active ingredient" refers to one or more substances belonging to any of the following categories: API (active pharmaceutical ingredient), food additives, natural medicaments, and naturally occurring substances that can have an effect on humans. Example active ingredients include any ingredient known to impact one or more biological functions within the body, such as ingredients that furnish pharmacological activity or other direct effect in the diagnosis, cure, mitigation, treatment, or prevention of disease, or which affect the structure or any function of the body of humans (e.g., provide a stimulating action on the central nervous system, have an energizing effect, an antipyretic or analgesic action, or an otherwise useful effect on the body). In some embodiments, the active ingredient may be of the type generally referred to as dietary supplements, nutraceuticals, "phytochemicals" or "functional foods." These types of additives are sometimes defined in the art as encompassing substances typically available from naturally-occurring sources (e.g., botanical materials) that provide one or more advantageous biological effects (e.g., health promotion, disease prevention, or other medicinal properties), but are not classified or regulated as drugs.

Non-limiting examples of active ingredients include those falling in the categories of botanical ingredients, stimulants, amino acids, nicotine components, and/or pharmaceutical, nutraceutical, and medicinal ingredients (e.g., vitamins, such as A, B3, B6, B12, and C, and/or cannabinoids, such as tetrahydrocannabinol (THC) and cannabidiol (CBD)). Each of these categories is further described herein below. The particular choice of active ingredients will vary depending upon the desired flavor, texture, and desired characteristics of the particular product. In certain embodiments, the active ingredient is selected from the group consisting of caffeine, taurine, GABA, theanine, vitamin C, lemon balm extract, ginseng, citicoline, sunflower lecithin, and combinations thereof. For example, the active ingredient can include a combination of caffeine, theanine, and optionally ginseng. In another embodiment, the active ingredient includes a combination of theanine, gamma-amino butyric acid (GABA), and lemon balm extract. In a further embodiment, the active ingredient includes theanine, theanine and tryptophan, or theanine and one or more B vitamins (e.g., vitamin B6 or B12). In a still further embodiment, the active ingredient includes a combination of caffeine, taurine, and vitamin C.

The particular percentages of active ingredients present will vary depending upon the desired characteristics of the particular product. Typically, an active ingredient or combination thereof is present in a total concentration of at least about 0.001% by weight of the composition, such as in a range from about 0.001% to about 20%. In some embodiments, the active ingredient or combination of active ingredients is present in a concentration from about 0.1% w/w to about 10% by weight, such as, e.g., from about 0.5% w/w to about 10%, from about 1% to about 10%, from about 1% to about 5% by weight, based on the total weight of the composition. In some embodiments, the active ingredient or combination of active ingredients is present in a concentration of from about 0.001%, about 0.01%, about 0.1%, or about 1%, up to about 20% by weight, such as, e.g., from about 0.001%, about 0.002%, about 0.003%, about 0.004%, about 0.005%, about 0.006%, about 0.007%, about 0.008%, about 0.009%, about 0.01%, about 0.02%, about 0.03%, about 0.04%, about 0.05%, about 0.06%, about 0.07%, about 0.08%, about 0.09%, about 0.1%, about 0.2%, about 0.3%, about 0.4%, about 0.5% about 0.6%, about 0.7%, about 0.8%, or about 0.9%, to about 1%, about 2%, about 3%, about 4%, about 5%, about 6%, about 7%, about 8%, about 9%, about 10%, about 11%, about 12%, about 13%, about 14%, about 15%, about 16%, about 17%, about 18%, about 19%, or about 20% by weight, based on the total weight of the composition. Further suitable ranges for specific active ingredients are provided herein below.

Botanical

In some embodiments, the active ingredient comprises a botanical ingredient. As used herein, the term "botanical ingredient" or "botanical" refers to any plant material or fungal-derived material, including plant material in its natural form and plant material derived from natural plant materials, such as extracts or isolates from plant materials or treated plant materials (e.g., plant materials subjected to heat treatment, fermentation, bleaching, or other treatment processes capable of altering the physical and/or chemical nature of the material). For the purposes of the present disclosure, a "botanical" includes, but is not limited to, "herbal materials," which refer to seed-producing plants that do not develop persistent woody tissue and are often valued for their medicinal or sensory characteristics (e.g., teas or tisanes). Reference to botanical material as "non-tobacco" is intended to exclude tobacco materials (i.e., does not include any *Nicotiana* species). In some embodiments, the compositions as disclosed herein can be characterized as free of any tobacco material (e.g., any embodiment as disclosed herein may be completely or substantially free of any tobacco material). By "substantially free" is meant that no tobacco material has been intentionally added. For example, certain embodiments can be characterized as having less than 0.001% by weight of tobacco, or less than 0.0001%, or even 0% by weight of tobacco.

When present, a botanical is typically at a concentration of from about 0.01% w/w to about 10% by weight, such as, e.g., from about 0.01% w/w, about 0.05%, about 0.1%, or about 0.5%, to about 1%, about 2%, about 3%, about 4%, about 5%, about 6%, about 7%, about 8%, about 9%, or about 10%, about 11%, about 12%, about 13%, about 14%, or about 15% by weight, based on the total weight of the composition.

The botanical materials useful in the present disclosure may comprise, without limitation, any of the compounds and sources set forth herein, including mixtures thereof. Certain botanical materials of this type are sometimes referred to as dietary supplements, nutraceuticals, "phytochemicals" or "functional foods." Certain botanicals, as the plant material or an extract thereof, have found use in traditional herbal medicine, and are described further herein. Non-limiting examples of botanicals or botanical-derived materials include ashwagandha, *Bacopa monniera*, baobab, basil, *Centella asiatica*, Chai-hu, chamomile, cherry blossom, chlorophyll, cinnamon, citrus, cloves, cocoa, cordyceps, curcumin, damiana, *Dorstenia arifolia, Dorstenia odorata*, essential oils, eucalyptus, fennel, *Galphimia glauca*, ginger, *Ginkgo biloba*, ginseng (e.g., *Panax ginseng*), green tea, *Griffonia simplicifolia*, guarana, cannabis, hemp, hops, jasmine, *Kaempferia parviflora* (Thai ginseng), kava, lavender, lemon balm, lemongrass, licorice, lutein, maca, matcha, *Nardostachys chinensis*, oil-based extract of *Viola odorata*, peppermint, quercetin, resveratrol, *Rhizoma gastrodiae, Rhodiola*, rooibos, rose essential oil, rosemary, *Sceletium tortuosum*, Schisandra, Skullcap, spearmint extract, Spikenard, terpenes, tisanes, turmeric, *Turnera aphrodisiaca*, valerian, white mulberry, and Yerba mate.

In some embodiments, the active ingredient comprises lemon balm. Lemon balm (*Melissa officinalis*) is a mildly lemon-scented herb from the same family as mint (Lamiaceae). The herb is native to Europe, North Africa, and West Asia. The tea of lemon balm, as well as the essential oil and the extract, are used in traditional and alternative medicine. In some embodiments, the active ingredient comprises lemon balm extract. In some embodiments, the lemon balm extract is present in an amount of from about 1 to about 4% by weight, based on the total weight of the composition.

In some embodiments, the active ingredient comprises ginseng. Ginseng is the root of plants of the genus *Panax*, which are characterized by the presence of unique steroid saponin phytochemicals (ginsenosides) and gintonin. *Ginseng* finds use as a dietary supplement in energy drinks or herbal teas, and in traditional medicine. Cultivated species include Korean ginseng (*P. ginseng*), South China ginseng (*P. notoginseng*), and American ginseng (*P. quinquefolius*). American ginseng and Korean ginseng vary in the type and quantity of various ginsenosides present. In some embodiments, the ginseng is American ginseng or Korean ginseng. In specific embodiments, the active ingredient comprises Korean ginseng. In some embodiments, ginseng is present in an amount of from about 0.4 to about 0.6% by weight, based on the total weight of the composition.

Stimulants

In some embodiments, the active ingredient comprises one or more stimulants. As used herein, the term "stimulant" refers to a material that increases activity of the central nervous system and/or the body, for example, enhancing focus, cognition, vigor, mood, alertness, and the like. Non-limiting examples of stimulants include caffeine, theacrine, theobromine, and theophylline. Theacrine (1,3,7,9-tetramethyluric acid) is a purine alkaloid which is structurally related to caffeine, and possesses stimulant, analgesic, and anti-inflammatory effects. Present stimulants may be natural, naturally derived, or wholly synthetic. For example, certain botanical materials (guarana, tea, coffee, cocoa, and the like) may possess a stimulant effect by virtue of the presence of e.g., caffeine or related alkaloids, and accordingly are "natural" stimulants. By "naturally derived" is meant the stimulant (e.g., caffeine, theacrine) is in a purified form, outside its natural (e.g., botanical) matrix. For example, caffeine can be obtained by extraction and purification from botanical sources (e.g., tea). By "wholly synthetic", it is meant that the stimulant has been obtained by chemical synthesis. In some embodiments, the active ingredient comprises caffeine. In some embodiments, the caffeine is present in an encapsulated form. On example of an encapsulated caffeine is Vitashure®, available from Balchem Corp., 52 Sunrise Park Road, New Hampton, N.Y., 10958.

When present, a stimulant or combination of stimulants (e.g., caffeine, theacrine, and combinations thereof) is typically at a concentration of from about 0.1% w/w to about 15% by weight, such as, e.g., from about 0.1% w/w, about 0.2%, about 0.3%, about 0.4%, about 0.5% about 0.6%, about 0.7%, about 0.8%, or about 0.9%, to about 1%, about 2%, about 3%, about 4%, about 5%, about 6%, about 7%, about 8%, about 9%, about 10%, about 11%, about 12%, about 13%, about 14%, or about 15% by weight, based on the total weight of the composition. In some embodiments, the composition comprises caffeine in an amount of from about 1.5 to about 6% by weight, based on the total weight of the composition.

Amino Acids

In some embodiments, the active ingredient comprises an amino acid. As used herein, the term "amino acid" refers to an organic compound that contains amine (—$NH_2$) and carboxyl (—COOH) or sulfonic acid ($SO_3H$) functional groups, along with a side chain (R group), which is specific to each amino acid. Amino acids may be proteinogenic or non-proteinogenic. By "proteinogenic" is meant that the amino acid is one of the twenty naturally occurring amino acids found in proteins. The proteinogenic amino acids include alanine, arginine, asparagine, aspartic acid, cysteine, glutamine, glutamic acid, glycine, histidine, isoleucine, leucine, lysine, methionine, phenylalanine, proline, serine, threonine, tryptophan, tyrosine, and valine. By "non-proteinogenic" is meant that either the amino acid is not found naturally in protein, or is not directly produced by cellular machinery (e.g., is the product of post-tranlational modification). Non-limiting examples of non-proteinogenic amino acids include gamma-aminobutyric acid (GABA), taurine (2-aminoethanesulfonic acid), theanine (L-γ-glutamylethylamide), hydroxyproline, and beta-alanine. In some embodiments, the active ingredient comprises theanine. In some embodiments, the active ingredient comprises GABA. In some embodiments, the active ingredient comprises a combination of theanine and GABA. In some embodiments, the active ingredient is a combination of theanine, GABA, and lemon balm. In some embodiments, the active ingredient is a combination of caffeine, theanine, and ginseng. In some embodiments, the active ingredient comprises taurine. In some embodiments, the active ingredient is a combination of caffeine and taurine.

When present, an amino acid or combination of amino acids (e.g., theanine, GABA, and combinations thereof) is typically at a concentration of from about 0.1% w/w to about 15% by weight, such as, e.g., from about 0.1% w/w, about 0.2%, about 0.3%, about 0.4%, about 0.5% about 0.6%, about 0.7%, about 0.8%, or about 0.9%, to about 1%, about 2%, about 3%, about 4%, about 5%, about 6%, about 7%, about 8%, about 9%, about 10%, about 11%, about 12%, about 13%, about 14%, or about 15% by weight, based on the total weight of the composition.

Vitamins

In some embodiments, the active ingredient comprises a vitamin or combination of vitamins. As used herein, the term "vitamin" refers to an organic molecule (or related set of molecules) that is an essential micronutrient needed for the proper functioning of metabolism in a mammal. There are thirteen vitamins required by human metabolism, which are: vitamin A (as all-trans-retinol, all-trans-retinyl-esters, as well as all-trans-beta-carotene and other provitamin A carotenoids), vitamin B1 (thiamine), vitamin B2 (riboflavin), vitamin B3 (niacin), vitamin B5 (pantothenic acid), vitamin B6 (pyridoxine), vitamin B7 (biotin), vitamin B9 (folic acid or folate), vitamin B12 (cobalamins), vitamin C (ascorbic acid), vitamin D (calciferols), vitamin E (tocopherols and tocotrienols), and vitamin K (quinones). In some embodiments, the active ingredient comprises vitamin C. In some embodiments, the active ingredient is a combination of vitamin C, caffeine, and taurine.

When present, a vitamin or combination of vitamins (e.g., vitamin B6, vitamin B12, vitamin E, vitamin C, or a combination thereof) is typically at a concentration of from about 0.01% w/w to about 6% by weight, such as, e.g., from about 0.01%, about 0.02%, about 0.03%, about 0.04%, about 0.05%, about 0.06%, about 0.07%, about 0.08%, about 0.09%, or about 0.1% w/w, to about 0.2%, about 0.3%, about 0.4%, about 0.5% about 0.6%, about 0.7%, about 0.8%, about 0.9%, about 1%, about 2%, about 3%, about 4%, about 5%, or about 6% by weight, based on the total weight of the composition.

Antioxidants

In some embodiments, the active ingredient comprises one or more antioxidants. As used herein, the term "antioxidant" refers to a substance which prevents or suppresses oxidation by terminating free radical reactions, and may delay or prevent some types of cellular damage. Antioxidants may be naturally occurring or synthetic. Naturally occurring antioxidants include those found in foods and botanical materials. Non-limiting examples of antioxidants include certain botanical materials, vitamins, polyphenols, and phenol derivatives.

Examples of botanical materials which are associated with antioxidant characteristics include without limitation acai berry, alfalfa, allspice, annatto seed, apricot oil, basil, bee balm, wild bergamot, black pepper, blueberries, borage seed oil, bugleweed, cacao, calamus root, catnip, catuaba, cayenne pepper, chaga mushroom, chervil, cinnamon, dark chocolate, potato peel, grape seed, ginseng, gingko biloba, Saint John's Wort, saw palmetto, green tea, black tea, black cohosh, cayenne, chamomile, cloves, cocoa powder, cranberry, dandelion, grapefruit, honeybush, echinacea, garlic, evening primrose, feverfew, ginger, goldenseal, hawthorn, hibiscus flower, jiaogulan, kava, lavender, licorice, marjoram, milk thistle, mints (menthe), oolong tea, beet root, orange, oregano, papaya, pennyroyal, peppermint, red clover, rooibos (red or green), rosehip, rosemary, sage, clary sage, savory, spearmint, spirulina, slippery elm bark, sorghum bran hi-tannin, sorghum grain hi-tannin, sumac bran, comfrey leaf and root, goji berries, gutu kola, thyme, turmeric, uva ursi, valerian, wild yam root, wintergreen, yacon root, yellow dock, yerba mate, yerba santa, bacopa monniera, withania somnifera, Lion's mane, and silybum marianum. Such botanical materials may be provided in fresh or dry form, essential oils, or may be in the form of an extracts. The botanical materials (as well as their extracts) often include compounds from various classes known to provide antioxidant effects, such as minerals, vitamins, isoflavones, phytoesterols, allyl sulfides, dithiolthiones, isothiocyanates, indoles, lignans, flavonoids, polyphenols, and carotenoids. Examples of compounds found in botanical extracts or oils include ascorbic acid, peanut endocarb, resveratrol, sulforaphane, beta-carotene, lycopene, lutein, co-enzyme Q, carnitine, quercetin, kaempferol, and the like. See, e.g., Santhosh et al., Phytomedicine, 12(2005) 216-220, which is incorporated herein by reference.

Non-limiting examples of other suitable antioxidants include citric acid, Vitamin E or a derivative thereof, a tocopherol, epicatechol, epigallocatechol, epigallocatechol gallate, erythorbic acid, sodium erythorbate, 4-hexylresorcinol, theaflavin, theaflavin monogallate A or B, theaflavin digallate, phenolic acids, glycosides, quercitrin, isoquercitrin, hyperoside, polyphenols, catechols, resveratrols, oleuropein, butylated hydroxyanisole (BHA), butylated hydroxytoluene (BHT), tertiary butylhydroquinone (TBHQ), and combinations thereof.

When present, an antioxidant is typically at a concentration of from about 0.001% w/w to about 10% by weight, such as, e.g., from about 0.001%, about 0.005%, about 0.01% w/w, about 0.05%, about 0.1%, or about 0.5%, to about 1%, about 2%, about 3%, about 4%, about 5%, about 6%, about 7%, about 8%, about 9%, or about 10%, based on the total weight of the composition.

Nicotine Component

In certain embodiments, the pouched products of the present disclosure can include a nicotinic compound. Various nicotinic compounds, and methods for their administration, are set forth in US Pat. Pub. No. 2011/0274628 to Borschke, which is incorporated herein by reference. As used herein, "nicotinic compound" or "source of nicotine" often refers to naturally-occurring or synthetic nicotinic compound unbound from a plant material, meaning the compound is at least partially purified and not contained within a plant structure, such as a tobacco leaf. Most preferably, nicotine is naturally-occurring and obtained as an extract from a *Nicotiana* species (e.g., tobacco). The nicotine can have the enantiomeric form S(−)-nicotine, R(+)-nicotine, or a mixture of S(−)-nicotine and R(+)-nicotine. Most preferably, the nicotine is in the form of S(−)-nicotine (e.g., in a form that is virtually all S(−)-nicotine) or a racemic mixture composed primarily or predominantly of S(−)-nicotine (e.g., a mixture composed of about 95 weight parts S(−)-nicotine and about 5 weight parts R(+)-nicotine). Most preferably, the nicotine is employed in virtually pure form or in an essentially pure form. Highly preferred nicotine that is employed has a purity of greater than about 95 percent, more preferably greater than about 98 percent, and most preferably greater than about 99 percent, on a weight basis.

In certain embodiments, a nicotine component may be included in the mixture in free base form, salt form, as a complex, or as a solvate. By "nicotine component" is meant any suitable form of nicotine (e.g., free base or salt) for providing oral absorption of at least a portion of the nicotine present. Typically, the nicotine component is selected from the group consisting of nicotine free base and a nicotine salt. In some embodiments, nicotine is in its free base form, which easily can be adsorbed in for example, a microcrystalline cellulose material to form a microcrystalline cellulose-nicotine carrier complex. See, for example, the discussion of nicotine in free base form in US Pat. Pub. No. 2004/0191322 to Hansson, which is incorporated herein by reference.

In some embodiments, at least a portion of the nicotine can be employed in the form of a salt. Salts of nicotine can be provided using the types of ingredients and techniques set forth in U.S. Pat. No. 2,033,909 to Cox et al. and Perfetti, *Beitrage Tabakforschung Int.,* 12: 43-54 (1983), which are incorporated herein by reference. Additionally, salts of nicotine are available from sources such as Pfaltz and Bauer, Inc. and K&K Laboratories, Division of ICN Biochemicals, Inc. Typically, the nicotine component is selected from the group consisting of nicotine free base, a nicotine salt such as hydrochloride, dihydrochloride, monotartrate, bitartrate, sulfate, salicylate, and nicotine zinc chloride. In some embodiments, the nicotine component or a portion thereof is a nicotine salt with one or more organic acids.

In some embodiments, at least a portion of the nicotine can be in the form of a resin complex of nicotine, where nicotine is bound in an ion-exchange resin, such as nicotine polacrilex, which is nicotine bound to, for example, a polymethacrilic acid, such as Amberlite IRP64, Purolite C115HMR, or Doshion P551. See, for example, U.S. Pat. No. 3,901,248 to Lichtneckert et al., which is incorporated herein by reference. Another example is a nicotine-polyacrylic carbomer complex, such as with Carbopol 974P. In some embodiments, nicotine may be present in the form of a nicotine polyacrylic complex.

Typically, the nicotine component (calculated as the free base) when present, is in a concentration of at least about 0.001% by weight of the mixture, such as in a range from about 0.001% to about 10%. In some embodiments, the nicotine component is present in a concentration from about 0.1% w/w to about 10% by weight, such as, e.g., from about 0.1% w/w, about 0.2%, about 0.3%, about 0.4%, about 0.5% about 0.6%, about 0.7%, about 0.8%, or about 0.9%, to about 1%, about 2%, about 3%, about 4%, about 5%, about 6%, about 7%, about 8%, about 9%, or about 10% by weight, calculated as the free base and based on the total weight of the mixture. In some embodiments, the nicotine component is present in a concentration from about 0.1% w/w to about 3% by weight, such as, e.g., from about 0.1% w/w to about 2.5%, from about 0.1% to about 2.0%, from about 0.1% to about 1.5%, or from about 0.1% to about 1% by weight, calculated as the free base and based on the total weight of the mixture. These ranges can also apply to other active ingredients noted herein.

In some embodiments, the products or compositions of the disclosure can be characterized as free of any nicotine component (e.g., any embodiment as disclosed herein may be completely or substantially free of any nicotine component). By "substantially free" is meant that no nicotine has been intentionally added, beyond trace amounts that may be naturally present in e.g., a botanical material. For example, certain embodiments can be characterized as having less than 0.001% by weight of nicotine, or less than 0.0001%, or even 0% by weight of nicotine, calculated as the free base.

In some embodiments, the active ingredient comprises a nicotine component (e.g., any product or composition of the disclosure, in addition to comprising any active ingredient or combination of active ingredients as disclosed herein, may further comprise a nicotine component).

Cannabinoids

In some embodiments, the active ingredient comprises one or more cannabinoids. As used herein, the term "cannabinoid" refers to a class of diverse chemical compounds that acts on cannabinoid receptors, also known as the endocannabinoid system, in cells that alter neurotransmitter release in the brain. Ligands for these receptor proteins include the endocannabinoids produced naturally in the body by animals; phytocannabinoids, found in cannabis; and synthetic cannabinoids, manufactured artificially. Cannabinoids found in cannabis include, without limitation: cannabigerol (CBG), cannabichromene (CBC), cannabidiol (CBD), tetrahydrocannabinol (THC), cannabinol (CBN), cannabinodiol (CBDL), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM), cannabinerolic acid, cannabidiolic acid (CBDA), cannabinol propyl variant (CBNV), cannabitriol (CBO), tetrahydrocannabinolic acid (THCA), and tetrahydrocannabivarinic acid (THCV A). In certain embodiments, the cannabinoid is selected from tetrahydrocannabinol (THC), the primary psychoactive compound in cannabis, and cannabidiol (CBD) another major constituent of the plant, but which is devoid of psychoactivity. All of the above compounds can be used in the form of an isolate from plant material or synthetically derived.

Alternatively, the active ingredient can be a cannabimimetic, which is a class of compounds derived from plants other than cannabis that have biological effects on the endocannabinoid system similar to cannabinoids. Examples include yangonin, alpha-amyrin or beta-amyrin (also classified as terpenes), cyanidin, curcumin (tumeric), catechin, quercetin, salvinorin A, N-acylethanolamines, and N-alkylamide lipids.

When present, a cannabinoid (e.g., CBD) or cannabimimetic is typically in a concentration of at least about 0.1% by weight of the composition, such as in a range from about 0.1% to about 30%, such as, e.g., from about 0.1%, about 0.2%, about 0.3%, about 0.4%, about 0.5% about 0.6%, about 0.7%, about 0.8%, or about 0.9%, to about 1%, about 2%, about 3%, about 4%, about 5%, about 6%, about 7%, about 8%, about 9%, about 10%, about 15%, about 20%, or about 30% by weight, based on the total weight of the composition.

Terpenes

Active ingredients suitable for use in the present disclosure can also be classified as terpenes, many of which are associated with biological effects, such as calming effects. Terpenes are understood to have the general formula of $(C_5H_8)_n$ and include monoterpenes, sesquiterpenes, and diterpenes. Terpenes can be acyclic, monocyclic or bicyclic in structure. Some terpenes provide an entourage effect when used in combination with cannabinoids or cannabimimetics. Examples include beta-caryophyllene, linalool, limonene, beta-citronellol, linalyl acetate, pinene (alpha or beta), geraniol, carvone, eucalyptol, menthone, iso-menthone, piperitone, myrcene, beta-bourbonene, and germacrene, which may be used singly or in combination.

Pharmaceutical Ingredients

In some embodiments, the active ingredient comprises an active pharmaceutical ingredient (API). The API can be any known agent adapted for therapeutic, prophylactic, or diagnostic use. These can include, for example, synthetic organic compounds, proteins and peptides, polysaccharides and other sugars, lipids, phospholipids, inorganic compounds (e.g., magnesium, selenium, zinc, nitrate), neurotransmitters or precursors thereof (e.g., serotonin, 5-hydroxytryptophan, oxitriptan, acetylcholine, dopamine, melatonin), and nucleic acid sequences, having therapeutic, prophylactic, or diagnostic activity. Non-limiting examples of APIs include analgesics and antipyretics (e.g., acetylsalicylic acid, acetaminophen, 3-(4-isobutylphenyl)propanoic acid), phosphatidylserine, myoinositol, docosahexaenoic acid (DHA, Omega-3), arachidonic acid (AA, Omega-6), S-adenosylmethionine (SAM), beta-hydroxy-beta-methylbutyrate (HMB), citicoline (cytidine-5'-diphosphate-choline), and cotinine. In some embodiments, the active ingredient comprises citicoline. In some embodiments, the active ingredient is a combination of citicoline, caffeine, theanine, and ginseng. In some embodiments, the active ingredient comprises sunflower lecithin. In some embodiments, the active ingredient is a combination of sunflower lecithin, caffeine, theanine, and ginseng.

The amount of API may vary. For example, when present, an API is typically at a concentration of from about 0.001% w/w to about 10% by weight, such as, e.g., from about 0.01%, about 0.02%, about 0.03%, about 0.04%, about 0.05%, about 0.06%, about 0.07%, about 0.08%, about 0.09%, about 0.1% w/w, about 0.2%, about 0.3%, about 0.4%, about 0.5% about 0.6%, about 0.7%, about 0.8%, about 0.9%, or about 1%, to about 2%, about 3%, about 4%, about 5%, about 6%, about 7%, about 8%, about 9%, or about 10% by weight, based on the total weight of the composition.

In some embodiments, the composition is substantially free of any API. By "substantially free of any API" means that the composition does not contain, and specifically excludes, the presence of any API as defined herein, such as any Food and Drug Administration (FDA) approved therapeutic agent intended to treat any medical condition.

Tobacco Material

In some embodiments, the mixture may include a tobacco material. The tobacco material can vary in species, type, and form. Generally, the tobacco material is obtained from for a harvested plant of the *Nicotiana* species. Example *Nicotiana* species include *N. tabacum, N. rustica, N. alata, N. arentsii, N. excelsior, N. forgetiana, N. glauca, N. glutinosa, N. gossei, N. kawakamii, N. knightiana, N. langsdorffi, N. otophora, N. setchelli, N. sylvestris, N. tomentosa, N. tomentosiformis, N. undulata, N. x sanderae, N. africana, N. amplexicaulis, N. benavidesii, N. bonariensis, N. debneyi, N. longiflora, N. maritina, N. megalosiphon, N. occidentalis, N. paniculata, N. plumbaginifolia, N. raimondii, N. rosulata, N. simulans, N. stocktonii, N. suaveolens, N. umbratica, N. velutina, N. wigandioides, N. acaulis, N. acuminata, N. attenuata, N. benthamiana, N. cavicola, N. clevelandii, N. cordifolia, N. corymbosa, N. fragrans, N. goodspeedii, N. linearis, N. miersii, N. nudicaulis, N. obtusifolia, N. occidentalis* subsp. *Hersperis, N. pauciflora, N. petunioides, N. quadrivalvis, N. repanda, N. rotundifolia, N. solanifolia*, and *N. spegazzinii*. Various representative other types of plants from the *Nicotiana* species are set forth in Goodspeed, *The Genus Nicotiana*, (Chonica Botanica) (1954); U.S. Pat. No. 4,660,577 to Sensabaugh, Jr. et al.; U.S. Pat. No. 5,387,416 to White et al., U.S. Pat. No. 7,025,066 to Lawson et al.; U.S. Pat. No. 7,798,153 to Lawrence, Jr. and U.S. Pat. No. 8,186,360 to Marshall et al.; each of which is incorporated herein by reference. Descriptions of various types of tobaccos, growing practices and harvesting practices are set forth in *Tobacco Production, Chemistry and Technology,* Davis et al. (Eds.) (1999), which is incorporated herein by reference.

*Nicotiana* species from which suitable tobacco materials can be obtained can be derived using genetic-modification or crossbreeding techniques (e.g., tobacco plants can be genetically engineered or crossbred to increase or decrease production of components, characteristics or attributes). See, for example, the types of genetic modifications of plants set forth in U.S. Pat. No. 5,539,093 to Fitzmaurice et al.; U.S. Pat. No. 5,668,295 to Wahab et al.; U.S. Pat. No. 5,705,624 to Fitzmaurice et al.; U.S. Pat. No. 5,844,119 to Weigl; U.S. Pat. No. 6,730,832 to Dominguez et al.; U.S. Pat. No. 7,173,170 to Liu et al.; U.S. Pat. No. 7,208,659 to Colliver et al. and U.S. Pat. No. 7,230,160 to Benning et al.; US Patent Appl. Pub. No. 2006/0236434 to Conkling et al.; and PCT WO2008/103935 to Nielsen et al. See, also, the types of tobaccos that are set forth in U.S. Pat. No. 4,660,577 to Sensabaugh, Jr. et al.; U.S. Pat. No. 5,387,416 to White et al.; and U.S. Pat. No. 6,730,832 to Dominguez et al., each of which is incorporated herein by reference.

The *Nicotiana* species can, in some embodiments, be selected for the content of various compounds that are present therein. For example, plants can be selected on the basis that those plants produce relatively high quantities of one or more of the compounds desired to be isolated therefrom. In certain embodiments, plants of the *Nicotiana* species (e.g., *Galpao commun* tobacco) are specifically grown for their abundance of leaf surface compounds. Tobacco plants can be grown in greenhouses, growth chambers, or outdoors in fields, or grown hydroponically.

Various parts or portions of the plant of the *Nicotiana* species can be included within a mixture as disclosed herein. For example, virtually all of the plant (e.g., the whole plant) can be harvested, and employed as such. Alternatively, various parts or pieces of the plant can be harvested or separated for further use after harvest. For example, the flower, leaves, stem, stalk, roots, seeds, and various combinations thereof, can be isolated for further use or treatment. In some embodiments, the tobacco material comprises tobacco leaf (lamina). The mixture disclosed herein can include processed tobacco parts or pieces, cured and aged tobacco in essentially natural lamina and/or stem form, a tobacco extract, extracted tobacco pulp (e.g., using water as a solvent), or a mixture of the foregoing (e.g., a mixture that combines extracted tobacco pulp with granulated cured and aged natural tobacco lamina).

In certain embodiments, the tobacco material comprises solid tobacco material selected from the group consisting of lamina and stems. The tobacco that is used for the mixture most preferably includes tobacco lamina, or a tobacco lamina and stem mixture (of which at least a portion is smoke-treated). Portions of the tobaccos within the mixture may have processed forms, such as processed tobacco stems (e.g., cut-rolled stems, cut-rolled-expanded stems or cut-puffed stems), or volume expanded tobacco (e.g., puffed tobacco, such as dry ice expanded tobacco (DIET)). See, for example, the tobacco expansion processes set forth in U.S. Pat. No. 4,340,073 to de la Burde et al.; U.S. Pat. No. 5,259,403 to Guy et al.; and U.S. Pat. No. 5,908,032 to Poindexter, et al.; and U.S. Pat. No. 7,556,047 to Poindexter, et al., all of which are incorporated by reference. In addition, the d mixture optionally may incorporate tobacco that has been fermented. See, also, the types of tobacco processing techniques set forth in PCT WO2005/063060 to Atchley et al., which is incorporated herein by reference.

The tobacco material is typically used in a form that can be described as particulate (i.e., shredded, ground, granulated, or powder form). The manner by which the tobacco material is provided in a finely divided or powder type of form may vary. Preferably, plant parts or pieces are comminuted, ground or pulverized into a particulate form using equipment and techniques for grinding, milling, or the like. Most preferably, the plant material is relatively dry in form during grinding or milling, using equipment such as hammer mills, cutter heads, air control mills, or the like. For example, tobacco parts or pieces may be ground or milled when the moisture content thereof is less than about 15 weight percent or less than about 5 weight percent. Most preferably, the tobacco material is employed in the form of parts or pieces that have an average particle size between 1.4 millimeters and 250 microns. In some instances, the tobacco particles may be sized to pass through a screen mesh to obtain the particle size range required. If desired, air classification equipment may be used to ensure that small sized tobacco particles of the desired sizes, or range of sizes, may be collected. If desired, differently sized pieces of granulated tobacco may be mixed together.

The manner by which the tobacco is provided in a finely divided or powder type of form may vary. Preferably, tobacco parts or pieces are comminuted, ground or pulverized into a powder type of form using equipment and techniques for grinding, milling, or the like. Most preferably, the tobacco is relatively dry in form during grinding or milling, using equipment such as hammer mills, cutter heads, air control mills, or the like. For example, tobacco parts or pieces may be ground or milled when the moisture content thereof is less than about 15 weight percent to less than about 5 weight percent. For example, the tobacco plant or portion thereof can be separated into individual parts or pieces (e.g., the leaves can be removed from the stems, and/or the stems and leaves can be removed from the stalk). The harvested plant or individual parts or pieces can be further subdivided into parts or pieces (e.g., the leaves can be shredded, cut, comminuted, pulverized, milled or ground into pieces or parts that can be characterized as filler-type pieces, granules, particulates or fine powders). The plant, or parts thereof, can be subjected to external forces or pressure (e.g., by being pressed or subjected to roll treatment). When carrying out such processing conditions, the plant or portion thereof can have a moisture content that approximates its natural moisture content (e.g., its moisture content immediately upon harvest), a moisture content achieved by adding moisture to the plant or portion thereof, or a moisture content that results from the drying of the plant or portion thereof. For example, powdered, pulverized, ground or milled pieces of plants or portions thereof can have moisture contents of less than about 25 weight percent, often less than about 20 weight percent, and frequently less than about 15 weight percent.

For the preparation of oral products, it is typical for a harvested plant of the *Nicotiana* species to be subjected to a curing process. The tobacco materials incorporated within the mixture for inclusion within products as disclosed herein are those that have been appropriately cured and/or aged. Descriptions of various types of curing processes for various types of tobaccos are set forth in *Tobacco Production, Chemistry and Technology*, Davis et al. (Eds.) (1999). Examples of techniques and conditions for curing flue-cured tobacco are set forth in Nestor et al., *Beitrage Tabakforsch. Int.,* 20, 467-475 (2003) and U.S. Pat. No. 6,895,974 to Peele, which are incorporated herein by reference. Representative techniques and conditions for air curing tobacco are set forth in U.S. Pat. No. 7,650,892 to Groves et al.; Roton et al., *Beitrage Tabakforsch. Int.,* 21, 305-320 (2005) and Staaf et al., *Beitrage Tabakforsch. Int.,* 21, 321-330 (2005), which are incorporated herein by reference. Certain types of tobaccos can be subjected to alternative types of curing processes, such as fire curing or sun curing.

In certain embodiments, tobacco materials that can be employed include flue-cured or Virginia (e.g., K326), burley, sun-cured (e.g., Indian Kurnool and Oriental tobaccos, including Katerini, Prelip, Komotini, Xanthi and Yambol tobaccos), Maryland, dark, dark-fired, dark air cured (e.g., Madole, Passanda, Cubano, Jatin and Bezuki tobaccos), light air cured (e.g., North Wisconsin and Galpao tobaccos), Indian air cured, Red Russian and *Rustica* tobaccos, as well as various other rare or specialty tobaccos and various blends of any of the foregoing tobaccos.

The tobacco material may also have a so-called "blended" form. For example, the tobacco material may include a mixture of parts or pieces of flue-cured, burley (e.g., Malawi burley tobacco) and Oriental tobaccos (e.g., as tobacco composed of, or derived from, tobacco lamina, or a mixture of tobacco lamina and tobacco stem). For example, a representative blend may incorporate about 30 to about 70 parts burley tobacco (e.g., lamina, or lamina and stem), and about 30 to about 70 parts flue cured tobacco (e.g., stem, lamina, or lamina and stem) on a dry weight basis. Other example tobacco blends incorporate about 75 parts flue-cured tobacco, about 15 parts burley tobacco, and about 10 parts Oriental tobacco; or about 65 parts flue-cured tobacco, about 25 parts burley tobacco, and about 10 parts Oriental tobacco; or about 65 parts flue-cured tobacco, about 10 parts burley tobacco, and about 25 parts Oriental tobacco; on a dry weight basis. Other example tobacco blends incorporate about 20 to about 30 parts Oriental tobacco and about 70 to about 80 parts flue-cured tobacco on a dry weight basis.

Tobacco materials used in the present disclosure can be subjected to, for example, fermentation, bleaching, and the like. If desired, the tobacco materials can be, for example, irradiated, pasteurized, or otherwise subjected to controlled heat treatment. Such treatment processes are detailed, for example, in U.S. Pat. No. 8,061,362 to Mua et al., which is incorporated herein by reference. In certain embodiments, tobacco materials can be treated with water and an additive capable of inhibiting reaction of asparagine to form acrylamide upon heating of the tobacco material (e.g., an additive selected from the group consisting of lysine, glycine, histidine, alanine, methionine, cysteine, glutamic acid, aspartic acid, proline, phenylalanine, valine, arginine, compositions incorporating di- and trivalent cations, asparaginase, certain non-reducing saccharides, certain reducing agents, phenolic compounds, certain compounds having at least one free thiol group or functionality, oxidizing agents, oxidation catalysts, natural plant extracts (e.g., rosemary extract), and combinations thereof. See, for example, the types of treatment processes described in U.S. Pat. Nos. 8,434,496, 8,944,072, and 8,991,403 to Chen et al., which are all incorporated herein by reference. In certain embodiments, this type of treatment is useful where the original tobacco material is subjected to heat in the processes previously described.

In some embodiments, the type of tobacco material is selected such that it is initially visually lighter in color than other tobacco materials to some degree (e.g., whitened or bleached). Tobacco pulp can be whitened in certain embodiments according to any means known in the art. For example, bleached tobacco material produced by various whitening methods using various bleaching or oxidizing agents and oxidation catalysts can be used. Example oxidizing agents include peroxides (e.g., hydrogen peroxide), chlorite salts, chlorate salts, perchlorate salts, hypochlorite salts, ozone, ammonia, potassium permanganate, and combinations thereof. Example oxidation catalysts are titanium dioxide, manganese dioxide, and combinations thereof. Processes for treating tobacco with bleaching agents are discussed, for example, in U.S. Pat. Nos. 787,611 to Daniels, Jr.; U.S. Pat. No. 1,086,306 to Oelenheinz; U.S. Pat. No. 1,437,095 to Delling; U.S. Pat. No. 1,757,477 to Rosenhoch; U.S. Pat. No. 2,122,421 to Hawkinson; U.S. Pat. No. 2,148,147 to Baier; U.S. Pat. No. 2,170,107 to Baier; U.S. Pat. No. 2,274,649 to Baier; U.S. Pat. No. 2,770,239 to Prats et al.; U.S. Pat. No. 3,612,065 to Rosen; U.S. Pat. No. 3,851,653 to Rosen; U.S. Pat. No. 3,889,689 to Rosen; U.S. Pat. No. 3,943,940 to Minami; U.S. Pat. No. 3,943,945 to Rosen; U.S. Pat. No. 4,143,666 to Rainer; U.S. Pat. No. 4,194,514 to Campbell; U.S. Pat. Nos. 4,366,823, 4,366,824, and 4,388,933 to Rainer et al.; U.S. Pat. No. 4,641,667 to Schmekel et al.; U.S. Pat. No. 5,713,376 to Berger; U.S. Pat. No. 9,339,058 to Byrd Jr. et al.; U.S. Pat. No. 9,420,825 to Beeson et al.; and U.S. Pat. No. 9,950,858 to Byrd Jr. et al.; as well as in US Pat. App. Pub. Nos. 2012/0067361 to Bjorkholm et al.; 2016/0073686 to Crooks; 2017/0020183 to Bjorkholm; and 2017/0112183 to Bjorkholm, and in PCT Publ. Appl. Nos. WO1996/031255 to Giolvas and WO2018/083114 to Bjorkholm, all of which are incorporated herein by reference.

In some embodiments, the whitened tobacco material can have an ISO brightness of at least about 50%, at least about 60%, at least about 65%, at least about 70%, at least about 75%, or at least about 80%. In some embodiments, the whitened tobacco material can have an ISO brightness in the range of about 50% to about 90%, about 55% to about 75%, or about 60% to about 70%. ISO brightness can be measured according to ISO 3688:1999 or ISO 2470-1:2016.

In some embodiments, the whitened tobacco material can be characterized as lightened in color (e.g., "whitened") in comparison to an untreated tobacco material. White colors are often defined with reference to the International Commission on Illumination's (CIE's) chromaticity diagram. The whitened tobacco material can, in certain embodiments, be characterized as closer on the chromaticity diagram to pure white than an untreated tobacco material.

In various embodiments, the tobacco material can be treated to extract a soluble component of the tobacco material therefrom. "Tobacco extract" as used herein refers to the isolated components of a tobacco material that are extracted from solid tobacco pulp by a solvent that is brought into contact with the tobacco material in an extraction process. Various extraction techniques of tobacco materials can be used to provide a tobacco extract and tobacco solid material. See, for example, the extraction processes described in US Pat. Appl. Pub. No. 2011/0247640 to Beeson et al., which is incorporated herein by reference. Other example techniques for extracting components of tobacco are described in U.S. Pat. No. 4,144,895 to Fiore; U.S. Pat. No. 4,150,677 to Osborne, Jr. et al.; U.S. Pat. No. 4,267,847 to Reid; U.S. Pat. No. 4,289,147 to Wildman et al.; U.S. Pat. No. 4,351,346 to Brummer et al.; U.S. Pat. No. 4,359,059 to Brummer et al.; U.S. Pat. No. 4,506,682 to Muller; U.S. Pat. No. 4,589,428 to Keritsis; U.S. Pat. No. 4,605,016 to Soga et al.; U.S. Pat. No. 4,716,911 to Poulose et al.; U.S. Pat. No. 4,727,889 to Niven, Jr. et al.; U.S. Pat. No. 4,887,618 to Bernasek et al.; U.S. Pat. No. 4,941,484 to Clapp et al.; U.S. Pat. No. 4,967,771 to Fagg et al.; U.S. Pat. No. 4,986,286 to Roberts et al.; U.S. Pat. No. 5,005,593 to Fagg et al.; U.S. Pat. No. 5,018,540 to Grubbs et al.; U.S. Pat. No. 5,060,669 to White et al.; U.S. Pat. No. 5,065,775 to Fagg; U.S. Pat. No. 5,074,319 to White et al.; U.S. Pat. No. 5,099,862 to White et al.; U.S. Pat. No. 5,121,757 to White et al.; U.S. Pat. No. 5,131,414 to Fagg; U.S. Pat. No. 5,131,415 to Munoz et al.; U.S. Pat. No. 5,148,819 to Fagg; U.S. Pat. No. 5,197,494 to Kramer; U.S. Pat. No. 5,230,354 to Smith et al.; U.S. Pat. No. 5,234,008 to Fagg; U.S. Pat. No. 5,243,999 to Smith; U.S. Pat. No. 5,301,694 to Raymond et al.; U.S. Pat. No. 5,318,050 to Gonzalez-Parra et al.; U.S. Pat. No. 5,343,879 to Teague; U.S. Pat. No. 5,360,022 to Newton; U.S. Pat. No. 5,435,325 to Clapp et al.; U.S. Pat. No. 5,445,169 to Brinkley et al.; U.S. Pat. No. 6,131,584 to Lauterbach; U.S. Pat. No. 6,298,859 to Kierulff et al.; U.S. Pat. No. 6,772,767 to Mua et al.; and U.S. Pat. No. 7,337,782 to Thompson, all of which are incorporated by reference herein.

Typical inclusion ranges for tobacco materials can vary depending on the nature and type of the tobacco material, and the intended effect on the final mixture, with an example range of up to about 30% by weight (or up to about 20% by weight or up to about 10% by weight or up to about 5% by weight), based on total weight of the mixture (e.g., about 0.1 to about 15% by weight).

In some embodiments, the products of the disclosure can be characterized as completely free or substantially free of tobacco material (other than purified nicotine as an active ingredient). For example, certain embodiments can be characterized as having less than 1% by weight, or less than 0.5% by weight, or less than 0.1% by weight of tobacco material, or 0% by weight of tobacco material.

Other Additives

Other additives can be included in the disclosed mixture. For example, the mixture can be processed, blended, formulated, combined and/or mixed with other materials or ingredients. The additives can be artificial, or can be obtained or derived from herbal or biological sources. Examples of further types of additives include thickening or gelling agents (e.g., fish gelatin), emulsifiers, oral care additives (e.g., thyme oil, eucalyptus oil, and zinc), preservatives (e.g., potassium sorbate and the like), zinc or magnesium salts selected to be relatively water soluble for compositions with greater water solubility (e.g., magnesium or zinc gluconate) or selected to be relatively water insoluble for compositions with reduced water solubility (e.g., magnesium or zinc oxide), disintegration aids, or combinations thereof. See, for example, those representative components, combination of components, relative amounts of those components, and manners and methods for employing those components, set forth in U.S. Pat. No. 9,237,769 to Mua et al., U.S. Pat. No. 7,861,728 to Holton, Jr. et al., US Pat. App. Pub. No. 2010/0291245 to Gao et al., and US Pat. App. Pub. No. 2007/0062549 to Holton, Jr. et al., each of which is incorporated herein by reference. Typical inclusion ranges for such additional additives can vary depending on the nature and function of the additive and the intended effect on the final mixture, with an example range of up to about 10% by weight, based on total weight of the mixture (e.g., about 0.1 to about 5% by weight).

The aforementioned additives can be employed together (e.g., as additive formulations) or separately (e.g., individual additive components can be added at different stages involved in the preparation of the final mixture). Furthermore, the aforementioned types of additives may be encapsulated as provided in the final product or mixture. Example encapsulated additives are described, for example, in WO2010/132444 to Atchley, which has been previously incorporated by reference herein.

In some embodiments, any one or more of a filler component, a tobacco material, and the overall oral product described herein can be described as a particulate material. As used herein, the term "particulate" refers to a material in the form of a plurality of individual particles, some of which can be in the form of an agglomerate of multiple particles, wherein the particles have an average length to width ratio less than 2:1, such as less than 1.5:1, such as about 1:1. In various embodiments, the particles of a particulate material can be described as substantially spherical or granular.

The particle size of a particulate material may be measured by sieve analysis. As the skilled person will readily appreciate, sieve analysis (otherwise known as a gradation test) is a method used to measure the particle size distribution of a particulate material. Typically, sieve analysis involves a nested column of sieves which comprise screens, preferably in the form of wire mesh cloths. A pre-weighed sample may be introduced into the top or uppermost sieve in the column, which has the largest screen openings or mesh size (i.e. the largest pore diameter of the sieve). Each lower sieve in the column has progressively smaller screen openings or mesh sizes than the sieve above. Typically, at the base of the column of sieves is a receiver portion to collect any particles having a particle size smaller than the screen opening size or mesh size of the bottom or lowermost sieve in the column (which has the smallest screen opening or mesh size).

In some embodiments, the column of sieves may be placed on or in a mechanical agitator. The agitator causes the vibration of each of the sieves in the column. The mechanical agitator may be activated for a pre-determined period of time in order to ensure that all particles are collected in the correct sieve. In some embodiments, the column of sieves is agitated for a period of time from 0.5 minutes to 10 minutes, such as from 1 minute to 10 minutes, such as from 1 minute to 5 minutes, such as for approximately 3 minutes. Once the agitation of the sieves in the column is complete, the material collected on each sieve is weighed. The weight of each sample on each sieve may then be divided by the total weight in order to obtain a percentage of the mass retained on each sieve. As the skilled person will readily appreciate, the screen opening sizes or mesh sizes for each sieve in the column used for sieve analysis may be selected based on the granularity or known maximum/minimum particle sizes of the sample to be analysed. In some embodiments, a column of sieves may be used for sieve analysis, wherein the column comprises from 2 to 20 sieves, such as from 5 to 15 sieves. In some embodiments, a column of sieves may be used for sieve analysis, wherein the column comprises 10 sieves. In some embodiments, the largest screen opening or mesh sizes of the sieves used for sieve analysis may be 1000 μm, such as 500 μm, such as 400 μm, such as 300 μm.

In some embodiments, any particulate material referenced herein (e.g., filler component, tobacco material, and the overall oral product) can be characterized as having at least 50% by weight of particles with a particle size as measured by sieve analysis of no greater than about 1000 μm, such as no greater than about 500 μm, such as no greater than about 400 μm, such as no greater than about 350 μm, such as no greater than about 300 μm. In some embodiments, at least 60% by weight of the particles of any particulate material referenced herein have a particle size as measured by sieve analysis of no greater than about 1000 μm, such as no greater than about 500 μm, such as no greater than about 400 μm, such as no greater than about 350 μm, such as no greater than about 300 μm. In some embodiments, at least 70% by weight of the particles of any particulate material referenced herein have a particle size as measured by sieve analysis of no greater than about 1000 μm, such as no greater than about 500 μm, such as no greater than about 400 μm, such as no greater than about 350 μm, such as no greater than about 300 μm. In some embodiments, at least 80% by weight of the particles of any particulate material referenced herein have a particle size as measured by sieve analysis of no greater than about 1000 μm, such as no greater than about 500 μm, such as no greater than about 400 μm, such as no greater than about 350 μm, such as no greater than about 300 μm. In some embodiments, at least 90% by weight of the particles of any particulate material referenced herein have a particle size as measured by sieve analysis of no greater than about 1000 μm, such as no greater than about 500 nm, such as no greater than about 400 μm, such as no greater than about 350 μm, such as no greater than about 300 μm. In some embodiments, at least 95% by weight of the particles of any particulate material referenced herein have a particle size as measured by sieve analysis of no greater than about 1000 μm, such as no greater than about 500 μm, such as no greater than about 400 μm, such as no greater than about 350 μm, such as no greater than about 300 μm. In some embodiments, at least 99% by weight of the particles of any particulate material referenced herein have a particle size as measured by sieve analysis of no greater than about 1000 μm, such as no greater than about 500 μm, such as no greater than about 400 μm, such as no greater than about 350 μm, such as no greater than about 300 μm. In some embodiments, approximately 100% by weight of the particles of any particulate material referenced herein have a particle size as measured by sieve analysis of no greater than about 1000 μm, such as no greater than about 500 μm, such as no greater than about 400 μm, such as no greater than about 350 μm, such as no greater than about 300 μm.

In some embodiments, at least 50% by weight, such as at least 60% by weight, such as at least 70% by weight, such as at least 80% by weight, such as at least 90% by weight, such as at least 95% by weight, such as at least 99% by weight of the particles of any particulate material referenced herein have a particle size as measured by sieve analysis of from about 0.01 μm to about 1000 μm, such as from about 0.05 μm to about 750 μm, such as from about 0.1 μm to about 500 μm, such as from about 0.25 μm to about 500 μm. In some embodiments, at least 50% by weight, such as at least 60% by weight, such as at least 70% by weight, such as at least 80% by weight, such as at least 90% by weight, such as at least 95% by weight, such as at least 99% by weight of the particles of any particulate material referenced herein have a particle size as measured by sieve analysis of from about 10 μm to about 400 μm, such as from about 50 μm to about 350 μm, such as from about 100 μm to about 350 μm, such as from about 200 μm to about 300 μm.

Preparation of the Mixture

The manner by which the various components of the mixture are combined may vary. As such, the overall mixture of various components with e.g., powdered mixture components may be relatively uniform in nature. The components noted above, which may be in liquid or dry solid form, can be admixed in a pretreatment step prior to mixture with any remaining components of the mixture, or simply mixed together with all other liquid or dry ingredients. The various components of the mixture may be contacted, combined, or mixed together using any mixing technique or equipment known in the art. Any mixing method that brings the mixture ingredients into intimate contact can be used, such as a mixing apparatus featuring an impeller or other structure capable of agitation. Examples of mixing equipment include casing drums, conditioning cylinders or drums, liquid spray apparatus, conical-type blenders, ribbon blenders, mixers available as FKM130, FKM600, FKM1200, FKM2000 and FKM3000 from Littleford Day, Inc., Plough Share types of mixer cylinders, Hobart mixers, and the like. See also, for example, the types of methodologies set forth in U.S. Pat. No. 4,148,325 to Solomon et al.; U.S. Pat. No. 6,510,855 to Korte et al.; and U.S. Pat. No. 6,834,654 to Williams, each of which is incorporated herein by reference. In some embodiments, the components forming the mixture are prepared such that the mixture thereof may be used in a starch molding process for forming the mixture. Manners and methods for formulating mixtures will be apparent to those skilled in the art. See, for example, the types of methodologies set forth in U.S. Pat. No. 4,148,325 to Solomon et al.; U.S. Pat. No. 6,510,855 to Korte et al.; and U.S. Pat. No. 6,834,654 to Williams, U.S. Pat. No. 4,725,440 to Ridgway et al., and U.S. Pat. No. 6,077,524 to Bolder et al., each of which is incorporated herein by reference.

Method of Making a Pouched Product

Various manufacturing apparatuses and methods can be used to create a pouched product described herein. For example, US Publication No. 2012/0055493 to Novak, III et al., previously incorporated by reference in its entirety, relates to an apparatus and process for providing pouch material formed into a tube for use in the manufacture of smokeless tobacco products. Similar apparatuses that incorporate equipment for supplying a continuous supply of a pouch material (e.g., a pouch processing unit adapted to supply a pouch material to a continuous tube forming unit for forming a continuous tubular member from the pouch material) can be used to create a pouched product described herein. Representative equipment for forming such a continuous tube of pouch material is disclosed, for example, in U.S. Patent Application Publication No. US 2010/0101588 to Boldrini et al., which is incorporated herein by reference in its entirety. The apparatus further includes equipment for supplying pouched material to the continuous tubular member such that, when the continuous tubular member is subdivided and sealed into discrete pouch portions, each pouch portion includes a charge of a composition adapted for oral use. Representative equipment for supplying the filler material is disclosed, for example, in U.S. Patent Application Publication No. US 2010/0018539 to Brinkley, which is incorporated herein by reference in its entirety. In some instances, the apparatus may include a subdividing unit for subdividing the continuous tubular member into individual pouch portions and, once subdivided into the individual pouch portions, may also include a sealing unit for sealing at least one of the ends of each pouch portion. In other instances, the continuous tubular member may be sealed into individual pouch portions with a sealing unit and then, once the individual pouch portions are sealed, the continuous tubular member may be subdivided into discrete individual pouch portions by a subdividing unit subdividing the continuous tubular member between the sealed ends of serially-disposed pouch portions. Still in other instances, sealing (closing) of the individual pouch portions of the continuous tubular member may occur substantially concurrently with the subdivision thereof, using a closing and dividing unit. It is noted that in certain embodiments of the present disclosure wherein a low melting point binder material is used, the temperature required for sealing the seams of the pouched product can be less than the temperature required in conventional processes associated with conventional binder materials. As a result, the pouch manufacturing process according to the present disclosure can require less energy and/or faster production of pouched products as compared to conventional processes. For at least these reasons, certain processes of the present disclosure can be more economical than conventional processes.

An example apparatus for manufacturing an oral pouch product is illustrated in FIGS. 1-5 of U.S. Publication No. 2012/0055493 to Novak, III et al.; however, this apparatus is used in a generic and descriptive sense only and not for purposes of limitation. It should also be appreciated that the following manufacturing process and related equipment is not limited to the process order described below. In various embodiments of the present disclosure, an apparatus similar to that described in U.S. Publication No. 2012/0055493 can be configured to removably receive a first bobbin on an unwind spindle assembly, the first bobbin having a continuous length of a material, such as a pouch material, wound thereon. When the first bobbin is engaged with the apparatus, the pouch material can be routed from the first bobbin to a forming unit configured to form a continuous supply of the pouch material into a continuous tubular member defining a longitudinal axis.

As such, as the pouch material is unwound from the first bobbin, the pouch material can be directed around an arrangement of roller members, otherwise referred to herein as a dancer assembly. A forming unit can be configured to cooperate with the first bobbin and the dancer assembly to take up slack in the pouch material and to maintain a certain amount of longitudinal tension on the pouch material as the pouch material is unwound from the first bobbin and fed to the forming unit, for example, by a drive system. One of ordinary skill in the art will appreciate that, between the first bobbin and the forming unit, the pouch material can be supported, routed, and/or guided by a suitably aligned series of any number of, for example, idler rollers, guideposts, air bars, turning bars, guides, tracks, tunnels, or the like, for directing the pouch material along the desired path. Typical bobbins used by conventional automated pouch making apparatuses often contain a continuous strip of pouch material of which the length may vary. As such, the apparatus described herein can be configured so as to handle bobbins of that type and size.

The forming unit can include one or more roller members configured to direct the pouch material about a hollow shaft such that the continuous supply of the pouch material can be formed into a continuous tubular member. The forming unit can include a sealing device configured to seal, fix, or otherwise engage lateral edges of the pouch material to form a longitudinally-extending seam, thereby forming a longitudinally-extending continuous tubular member. In various embodiments, an insertion unit can be configured to introduce charges of the composition adapted for oral use into the continuous tubular member through the hollow shaft. The insertion unit may be directly or indirectly engaged with the hollow shaft.

A leading edge or end (also referred to as a laterally-extending seam) of the continuous tubular member can be closed/sealed such that a charge of composition adapted for oral use inserted by the insertion unit, is contained within the continuous tubular member proximate to the leading end. The leading end can be closed/sealed via a closing and dividing unit configured to close/seal a first portion of the continuous tubular member to form the closed leading end of a pouch member portion. The closing and dividing unit can also be configured to form a closed trailing edge or end of a previous pouch member portion. In this regard, the closing and dividing unit can also be configured to close a second portion of the continuous tubular member to form the closed trailing end of the pouch member portion. In this regard, the closing and dividing unit can close the ends, by heat-sealing, or other suitable sealing mechanism.

As discussed above, a low melting point binder coating is applied to/incorporated into the nonwoven web of the pouch material and acts as a heat sealable binder to seal the pouch once the composition adapted for oral use is inserted within the outer water-permeable pouch. As noted above, the temperature required for sealing the seams of the pouched product can be lower than temperatures associated with conventional processes due to the selection of particular binder materials described herein.

As illustrated in FIGS. 20-22 of U.S. Publication No. 2012/0055493 to Novak, III et al., the closing and dividing unit can be configured to divide the continuous tubular member, between the closed trailing end and the closed leading end of serially-disposed pouch member portions, along the longitudinal axis of the continuous tubular member, and into a plurality of discrete pouch member portions such that each discrete pouch member portion includes a portion of the oral composition from the insertion unit. In this regard, the closing and dividing unit can include a blade, heated wire, or other cutting arrangement for severing the continuous tubular member into discrete pouch member portions. For example, the closing and dividing unit can include first and second arm members configured to interact to close and divide the continuous tubular member.

In operation, a charge of the composition adapted for oral use (i.e., an amount suitable for an individual pouch member portion) can be supplied to the pouch member portion by an insertion unit after a leading end has been closed, but prior to the closing of a trailing end. In various embodiments, after receiving the charge of the oral composition, the discrete individual pouch member portion can be formed by closing the trailing end and severing the closed pouch member portion from the continuous tubular member such that an individual pouched product is formed.

The amount of material contained within each pouch may vary. In various embodiments, the weight of the mixture within each pouch is at least about 50 mg, for example, from about 50 mg to about 2 grams, from about 100 mg to about 1.5 grams, or from about 200 mg to about 700 mg. In certain smaller embodiments, the dry weight of the material within each pouch is at least about 50 mg to about 150 mg. For some larger embodiment, the dry weight of the material within each pouch preferably does not exceed about 300 mg to about 500 mg. In some embodiments, each pouch/container may have disposed therein a flavor agent member, as described in greater detail in U.S. Pat. No. 7,861,728 to Holton, Jr. et al., which is incorporated herein by reference. For example, at least one flavored strip, piece or sheet of flavored water dispersible or water soluble material (e.g., a breath-freshening edible film type of material) may be disposed within each pouch along with or without at least one capsule. Such strips or sheets may be folded or crumpled in order to be readily incorporated within the pouch. See, for example, the types of materials and technologies set forth in U.S. Pat. No. 6,887,307 to Scott et al. and U.S. Pat. No. 6,923,981 to Leung et al.; and The EFSA Journal (2004) 85, 1-32; which are incorporated herein by reference.

In various embodiments, the nonwoven web can be sufficiently tacky so as to create issues with high-speed pouching equipment. Therefore, in certain embodiments, a Teflon coating, or similar material, can be applied to one or more surfaces of the pouching equipment that touch the nonwoven web such as, for example, rollers, cutting instruments, and heat sealing devices in order to reduce and/or alleviate any problems associated with the pouch material sticking to the pouching equipment during processing.

As illustrated in FIG. 3, for example, a method of manufacturing a pouched product can comprise a number of general, non-limiting operations that can be performed in any desirable order. At operation 100, a continuous supply of a pouch material in the form of a nonwoven web comprising a low melting point heat sealable binder coating can be provided. At operation 105, the pouch material is formed into a continuous tubular member by sealing the lateral edges of the pouch material such that a longitudinally-extending seam is formed. As noted herein, the seam can be formed by applying conventional heat sealing techniques to the pouch material, resulting in softening and/or melting of the heat sealable binder material in the nonwoven web to form a seal. At operation 110, a charge of a composition adapted for oral use can be inserted into the continuous tubular member. At operation 115, the continuous tubular member can be subdivided at predetermined intervals so as to form a plurality of pouch member portions, wherein each pouch member portion includes a charge of the composition. At operation 120, each discrete pouch portion can be entirely sealed such that an outer water-permeable pouch is formed that encloses the composition. This second sealing step can involve applying conventional heat sealing techniques to the pouch material, resulting in softening and/or melting of the heat sealable binder material in the nonwoven web to form a seal. Accordingly, aspects of the present disclosure are particularly configured to provide discrete pouched products. The operations described and the order of the method steps illustrated herein are not construed as limiting thereof.

The pouched products can further include product identifying information printed or dyed on the outer water-permeable pouch or imprinted (e.g., embossed, debossed, or otherwise pressed) on the outer water-permeable pouch, such as described in U.S. Pat. Appl. Pub. No. 2014/0255452 to Reddick et al., filed Mar. 11, 2013, which is incorporated by reference herein. As noted above, flavorants can also be incorporated into the nonwoven web if desired, such as by coating or printing an edible flavorant ink onto the nonwoven web. See, e.g., U.S. Pat. Appl. Pub. Nos. 2012/0085360 to Kawata et al. and 2012/0103353 to Sebastian et al., each of which is herein incorporated by reference.

A pouched product as described herein can be packaged within any suitable inner packaging material and/or outer container. See also, for example, the various types of containers for smokeless types of products that are set forth in U.S. Pat. No. 7,014,039 to Henson et al.; U.S. Pat. No. 7,537,110 to Kutsch et al.; U.S. Pat. No. 7,584,843 to Kutsch et al.; U.S. Pat. No. 8,397,945 to Gelardi et al., U.S. Pat. No. D592,956 to Thiellier; U.S. Pat. No. D594,154 to Patel et al.; and U.S. Pat. No. D625,178 to Bailey et al.; US Pat. Pub. Nos. 2008/0173317 to Robinson et al.; 2009/0014343 to Clark et al.; 2009/0014450 to Bjorkholm; 2009/0250360 to Bellamah et al.; 2009/0266837 to Gelardi et al.; 2009/0223989 to Gelardi; 2009/0230003 to Thiellier; 2010/0084424 to Gelardi; and 2010/0133140 to Bailey et al; 2010/0264157 to Bailey et al.; and 2011/0168712 to Bailey et al. which are incorporated herein by reference.

Products of the present disclosure configured for oral use may be packaged and stored in any suitable packaging in much the same manner that conventional types of smokeless tobacco products are packaged and stored. For example, a plurality of packets or pouches may be contained in a cylindrical container. The storage period of the product after preparation may vary. As used herein, "storage period" refers to the period of time after the preparation of the disclosed product. In some embodiments, one or more of the characteristics of the products disclosed herein (e.g., retention of whiteness, lack of color change, retention of volatile flavor components) is exhibited over some or all of the storage period. In some embodiments, the storage period (i.e., the time period after preparation) is at least one day. In some embodiments, the storage period is from about about 1 day, about 2 days, or about 3 days, to about 1 week, or from about 1 week to about 2 weeks, from about 2 weeks to about 1 month, from about 1 month to about 2 months, from about 2 months to about 3 months, from about 3 months to about 4 months, or from about 4 months to about 5 months. In some embodiments, the storage period is any number of days between about 1 and about 150. In certain embodiments, the storage period may be longer than 5 months, for example, about 6 months, about 7 months, about 8 months, about 9 months, about 10 months, about 11 months, or about 12 months.

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A pouched product comprising:

an outer water-permeable pouch defining a cavity; and a composition comprising a water-soluble component, the composition comprising a cellulose material or cellulose derivative in an amount of about 40 to about 75% by weight, based on the total weight of the composition, and wherein the composition is substantially free of a tobacco material;

wherein the composition is situated in the cavity;

wherein the outer water-permeable pouch is a multilayer composite comprising two or more nonwoven layers and comprising a heat sealable binder, wherein the two or more nonwoven layers comprise a first layer comprising regenerated cellulose fibers and a second layer comprising biodegradable fibers, wherein the outer water-permeable pouch is point bonded on less than 30% of the surface area thereof and has a basis weight of about 20 gsm to about 35 gsm;

wherein the heat sealable binder comprises a biodegradable polymer and is in the form of a liquid coating or a powder;

wherein the heat sealable binder has a melting point of about 300° C. or less, wherein the heat sealable binder further comprises a placticizer.

2. The pouched product of claim 1, wherein the heat sealable binder has a melting point of about 150° C. or less.

3. The pouched product of claim 1, wherein the heat sealable binder has a melting point of about 100° C. or less.

4. The pouched product of claim 1, wherein the biodegradable polymer is an aliphatic polyester.

5. The pouched product of claim 4, wherein the aliphatic polyester is selected from the group consisting of polyglycolide or poly glycolic acid (PGA), polylactide or poly lactic acid (PLA), polycaprolactone (PCL), polyethylene adipate (PEA), polyhydroxyalkonoate (PHA), polyhydroxybutyrate (PHB), poly (3-hydroxybutyrate-co-3-hydroxy valerate) (PHBV), and polylactide-co-glycolide.

6. The pouched product of claim 1, wherein the composition comprises an active ingredient selected from the group consisting of a nicotine component, botanicals, stimulants, nutraceuticals, amino acids, vitamins, cannabinoids, cannabimimetics, terpenes, and combinations thereof.

7. The pouched product of claim 1, wherein the biodegradable polymer of the heat sealable binder further comprises an additive to reduce the molecular weight of the biodegradable polymer.

8. The pouched product of claim 7, wherein the additive is selected from the group consisting of pentaerythritol, water, sodium hydroxide, hydrated alumina trihydrate, ethylene glycol, and combinations thereof.

9. The pouched product of claim 7, wherein the additive is selected from the group consisting of pentaerythritol, hydrated alumina trihydrate, ethylene glycol, and combinations thereof.

10. The pouched product of claim 1, wherein the plasticizer is an aliphatic diester and/or a polyhydroxyalkanoate.

11. A method of preparing a water-permeable pouch material, comprising:

providing a first fibrous web comprising a plurality of fibers and a heat sealable binder material;

mechanically entangling the first fibrous web to form a first nonwoven layer;

associating the first nonwoven layer with a second nonwoven layer to give a multilayer composite, wherein one of the first and second nonwoven layers comprises regenerated cellulose fibers and wherein the other of the first and second nonwoven layers comprises biodegradable fibers, point bonding the multilayer composite on less than 30% of the surface area thereof; and heating the multilayer composite to at least partially melt the heat sealable binder material to form the water-permeable pouch material;

wherein the heat sealable binder material is in the form of a liquid coating or a powder and has a melting point of about 300° C. or less and further comprises a plasticizer, and wherein the water-permeable pouch material has a basis weight of about 20 gsm to about 35 gsm.

12. The method of claim 11, further comprising:

providing a continuous supply of the pouch material;

engaging lateral edges of the pouch material such that a longitudinally-extending seam is formed;

sealing the longitudinally-extending seam such that a continuous tubular member is formed from the continuous supply of pouch material;

inserting a composition adapted for oral use into the continuous tubular member;

subdividing the continuous tubular member into discrete pouch portions such that each pouch portion includes a composition charge; and sealing a leading and an end edge of each discrete pouch portion such that an outer water-permeable pouch is formed that encloses the composition charge.

13. A pouched product prepared according to the method of claim 12.

14. A method of enhancing biodegradability of a pouched product, comprising:

providing a multilayer composite comprising two or more nonwoven layers and comprising low melting point heat sealable binder material, wherein the heat sealable binder material has a melting point of about 300° C. or less, and wherein the heat sealable binder material comprises a biodegradable polymer and is in the form of a liquid coating or a powder wherein the two or more nonwoven layers comprise a first layer comprising regenerated cellulose fibers and a second layer comprising biodegradable fibers;

forming a water-permeable pouch from the multilayer composite; and enclosing a composition comprising a water soluble component within the water-permeable pouch to form the pouched product, the composition comprising a cellulose material or cellulose derivative in an amount of about 40 to about 75% by weight, based on the total weight of the composition, and wherein the composition is substantially free of a tobacco material;

wherein the water-soluble component is capable of being released through the water-permeable pouch, and wherein the heat sealable binder further comprises a placticizer, and wherein the water-permeable pouch is point bonded on less than 30% of the surface area thereof and has a basis weight of about 20 gsm to about 35 gsm.

15. A pouched product formed according to the method of claim 14, wherein the pouched product exhibits enhanced degradability as compared with a conventional pouched product that is otherwise comparable but does not comprise the low melting point heat sealable binder material.

16. A method of preparing a water-permeable pouch material, comprising:

providing a first fibrous web comprising a plurality of fibers and a heat sealable binder material;

mechanically entangling the first fibrous web to form a first nonwoven layer;

associating the first nonwoven layer with a second nonwoven layer to give a multilayer composite, wherein one of the first and second nonwoven layers comprises regenerated cellulose fibers and wherein the other of the first and second nonwoven layers comprises biodegradable fibers, point bonding the multilayer composite on less than 30% of the surface area thereof; and heating the multilayer composite to at least partially melt the heat sealable binder material to form the water-permeable pouch material;

wherein the heat sealable binder material is in the form of a liquid coating or a powder and has a melting point of about 300° C. or greater, and wherein the heat sealable binder further comprises a placticizer;

and wherein the water-permeable pouch material has a basis weight of about 20 gsm to about 35 gsm.

17. The method of claim 16, further comprising:

providing a continuous supply of the pouch material;

engaging lateral edges of the pouch material such that a longitudinally-extending seam is formed;

sealing the longitudinally-extending seam such that a continuous tubular member is formed from the continuous supply of pouch material;

inserting a composition adapted for oral use into the continuous tubular member;

subdividing the continuous tubular member into discrete pouch portions such that each pouch portion includes a composition charge; and sealing a leading and an end edge of each discrete pouch portion such that an outer water-permeable pouch is formed that encloses the composition charge.

* * * * *